US007849566B2

(12) United States Patent
Yamamoto

(10) Patent No.: US 7,849,566 B2
(45) Date of Patent: Dec. 14, 2010

(54) CLASP, BAND WITH A CLASP, PORTABLE DEVICE, TIMEPIECE, AND ACCESSORY

(75) Inventor: Akio Yamamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 186 days.

(21) Appl. No.: 12/060,658

(22) Filed: Apr. 1, 2008

(65) Prior Publication Data

US 2008/0250612 A1 Oct. 16, 2008

(30) Foreign Application Priority Data

Apr. 12, 2007 (JP) ..... 2007-104848
Dec. 25, 2007 (JP) ..... 2007-332720

(51) Int. Cl.
*A44C 5/18* (2006.01)

(52) U.S. Cl. ..... 24/265 WS; 24/71 J; 24/68 J; 24/656

(58) Field of Classification Search ..... 24/265 WS, 24/614, 615, 265 BC, 906, 625, 629, 630, 24/634, 180, 181, 68 J, 69 J, 71 J
See application file for complete search history.

(56) References Cited

U.S. PATENT DOCUMENTS 2,532,840 A * 12/1950 Gaun ..... 24/71 R
3,797,716 A * 3/1974 Mochizuki ..... 24/71 J
4,150,464 A * 4/1979 Tracy ..... 24/313
4,675,955 A * 6/1987 Nakamura ..... 24/656
4,912,950 A * 4/1990 Crowle ..... 70/58
4,928,359 A * 5/1990 Gagnebin ..... 24/71 J
5,086,547 A * 2/1992 Ziemelis ..... 24/615
5,134,538 A * 7/1992 Weiss ..... 361/220
5,175,912 A * 1/1993 Chevalley et al. ..... 24/68 J
5,191,685 A * 3/1993 Aoki et al. ..... 24/656
5,305,503 A * 4/1994 Yamagata ..... 24/68 J
5,313,691 A * 5/1994 Hashimoto ..... 24/69 J
5,485,659 A * 1/1996 Kashikie et al. ..... 24/71 J
5,787,554 A * 8/1998 Hashimoto ..... 24/68 J
5,826,309 A * 10/1998 Tsamas ..... 24/68 J
6,023,816 A * 2/2000 Okada et al. ..... 24/71 J
6,681,453 B1 * 1/2004 Hashimoto et al. ..... 24/265 WS
6,944,916 B2 * 9/2005 Kawagoe ..... 24/71 J

FOREIGN PATENT DOCUMENTS

CH 281531 6/1952

(Continued)

*Primary Examiner*—Robert J Sandy
*Assistant Examiner*—Rowland D Do
(74) *Attorney, Agent, or Firm*—Global IP Counselors, LLP

(57) ABSTRACT

A clasp has a first member and a second member that are disposed to two coupled members. The clasp is closed by the first member and the second member mutually engaging when the coupled members slide in relatively opposite directions. The first member has a first attachment member that has side walls, a spine that connects the side walls, and a button unit that has a push button which is urged to the outside from the inside of the coupled members in the direction intersecting the sliding direction of the coupled members. The second member has a second attachment member that has side walls attached at a prescribed position to the other coupled member on both sides. The first attachment member and the button unit are attached at a prescribed position to the one coupled member.

14 Claims, 30 Drawing Sheets

FOREIGN PATENT DOCUMENTS

| | | | |
|---|---|---|---|
| FR | 1101905 | A | 10/1955 |
| JP | H09-201212 | A | 8/1997 |
| JP | H10-028605 | A | 2/1998 |
| JP | H11-346811 | A | 12/1999 |
| WO | WO-88/00225 | A1 | 4/1988 |

* cited by examiner

CLASP, BAND WITH A CLASP, PORTABLE DEVICE, TIMEPIECE, AND ACCESSORY

BACKGROUND

1. Field of Invention

The present invention relates to a clasp for securing a coupled member such as a strap or a band. The invention also relates to a band that has this clasp, to a portable device that has the band, to a timepiece, and to an accessory.

2. Description of Related Art

One type of conventional clasp for securing the free ends of a timepiece band has a frame disposed freely pivotably to the band with a protruding stud, and a push button catch that holds the stud with spring force. See, for example, Japanese Unexamined Patent Appl. Pub. JP-A-H10-28605.

The stud part of this clasp has a small diameter shank that rises from the frame, and a larger diameter head at the distal end of the shank. When the clasp is closed and locked, the stud is inserted through a hole in the band and the large diameter head of the stud protruding from the hole in the band is engaged and held in the hole in the push button catch.

Some problems with the clasp taught in Japanese Unexamined Patent Appl. Pub. JP-A-H10-28605 are described below.

(1) Every time the band is attached to and removed from the wrist, the stud must pass through a hole in the band. Every time the stud is removed from a hole in the band, the large diameter head of the stud catches the edge of the engaged hole in the band on the back side of the band, and the area around the hole is thus easily damaged. More specifically, when the timepiece is held by the band on the wrist, the rigidity of the band produces tensile force that causes the shank of the stud to be offset from the center of the hole in the band so that the small diameter part of the stud contacts the inside circumference surface of the hole. When the stud is then removed from the hole, the large diameter head catches the edge of the hole in the band, and the area around the hole is thus easily damaged.

As a result, when the clasp causes the push button catch to engage a stud at a hole in the band, a load acts on only a part of the band when the clasp is opened and closed, and the durability of the band is thus low.

(2) Aligning the stud with the hole in the band when inserting the stud into the hole can be difficult, and securing the clasp can therefore be difficult. More particularly, the two parts of the band must be correctly positioned together when connecting the two free ends of the band, and the stud attached to the end of the one band must be positioned to the hole in the other band, but the stud is hidden on the back side of the band and is difficult to see.

Even if the stud is disposed to a position on the opposite side described in Japanese Unexamined Patent Appl. Pub. JP-A-H10-28605, such as when the stud is disposed to a plate member that contacts the wrist and the opposing band is placed over the plate to pass the stud through the hole, the stud is still hidden on the back side of the band. This means that it is still difficult to align the stud with the hole in the band, and it is still difficult to secure the band.

Furthermore, if there are multiple holes in the band there is no assurance that the stud will always pass through the desired hole when putting the band on, and the length of the fastened band may therefore differ from the desired length.

SUMMARY

A clasp according to the present invention can be easily opened and closed and affords excellent durability in the band or other secured member.

Another aspect of the invention is a strap or bracelet having this clasp. A further aspect of the invention is an accessory, a timepiece, or a portable device having this strap or bracelet.

A clasp according to a first aspect of the invention has a first member and a second member that are respectively disposed to two coupled members, the clasp being closed by the first member and the second member mutually engaging when the coupled members slide in relatively opposite directions. The first member has a first attachment member that has a side wall disposed on both sides of a direction intersecting the direction in which one of the coupled members slides, and a spine that connects the side walls, and a button unit that has a push button which is urged to the outside from the inside of the coupled members in the direction intersecting the sliding direction of the coupled members, and which is disposed with the one coupled member held between the first attachment member and the button unit. The second member has a second attachment member that has a side wall attached at a prescribed position to the other coupled member on both sides of a direction intersecting the direction in which the other coupled member slides. The first attachment member and the button unit are attached at a prescribed position to the one coupled member. The button unit has a protruding catch that moves in conjunction with the push button and engages the side walls of the second attachment member when the coupled members are slid together. The side walls of the second attachment member have a recessed strike to which the protruding catch is inserted from the inside of the side walls.

For convenience and simplicity, the coupled members are referred to herein as "bands," but the coupled members of the invention are not limited to bands. More particularly, the clasp of the invention is characterized by a first member and a second member that lock together when the coupled members are slid together, and the coupled members can have any shape that enables sliding them together and apart.

Also for convenience, the direction in which the coupled members slide is below referred to as the length of the bands, and the direction intersecting the sliding direction of the coupled members is the width of the bands.

It will also be noted that the coupled members can be parts of other members.

The first member having the first attachment member and button unit is attached by a suitable means to a specific position on one of the bands (coupled members). Such a suitable means includes, for example, a stud or wedge that is disposed to either the first attachment member or the button unit and presses and holds the band against the other of the first attachment member and button unit.

The second member having the second attachment member is attached by a suitable means to the other band (coupled member) at a specific position. For example, the ends of a rod-shaped member disposed across the width of the other band (in the direction intersecting the sliding direction of the bands) could be engaged with the side walls of the second attachment member to attach the second attachment member to a specific position on the other band.

The first member and the second member are each attached to a specific position on one of the bands, and the band to which the first member is attached and the band to which the second member is attached are slid in mutually opposite directions so that the first member and the second member come together, causing the protruding catch and the recessed strike to engage and thereby lock the first member and second member together.

The first member and second member thus determine the position where the bands are buckled together, eliminating the need to position the bands to each other when buckling the bands. Furthermore, because the first member and the second member slide together and couple as a result of simply sliding the bands, the bands can be fastened at the desired band length every time the bands are buckled together by means of a simple operation.

Furthermore, because pressing the push button causes the protruding catch to recede to the inside widthwise to the bands and disengage the recessed strike, the bands can slide apart and the bands can be easily unbuckled.

The invention also improves the durability of the bands because the bands can be buckled and unbuckled by a simple sliding action, and a wearing load is not locally applied to the bands as a result of passing a stud through hole in the band each time the bands are buckled and unbuckled.

In the clasp according to another aspect of the invention the second attachment member has a spine connected between the side walls of the second attachment member; and the one coupled member is inserted between the spine of the second attachment member and the other coupled member when the coupled members are slid together.

This aspect of the invention enables sliding the end of the one band that is disposed between the first attachment member and the button unit between the spine of the second attachment member and the other band to engage the protruding catch and recessed strike. The spine of the second attachment member acts as a guide member in this arrangement so that the one band passed between the spine and the other band can be pulled to engage the protruding catch and recessed strike, and the bands can be easily buckled together with one hand.

In another aspect of the invention, when the one coupled member is attached to the attached object to which the coupled members are attached, the one coupled member is located on the attached object side of the button unit, and the coupled members are slid with the second attachment member placed on the button unit side of the one coupled member.

With this aspect of the invention the second attachment member is placed on one band, and the first attachment member and the second attachment member are squeezed together using the thumb and index finger, for example, thus causing the bands to slide in opposite directions together and the protruding catch and recessed strike to engage. The bands can thus be easily buckled together with one hand.

The attached object to which the bands are attached is, for example, the wrist, and the first attachment member, the one band, and the button unit are arranged in order from the attached object (wrist) side through the thickness of the bands.

In another aspect of the invention, the spine of the first member or the button unit has a stud that protrudes toward the other of the spine and the button unit, and the stud is inserted to a hole formed in the one coupled member.

Because the planar position of the first attachment member and button unit to the band is determined by inserting the stud to a hole in the band, the first attachment member and button unit can be reliably fixed to a specific position on the band.

The diameter of the stud can be the same along the entire length of the stud.

Further preferably, an opening is formed in the side walls of the first attachment member, and the first attachment member and the button unit are assembled in unison by means of the push button passing through the opening.

When the first member is attached to one band, the band is disposed between the first attachment member and the button unit, the push buttons are pressed inside the side walls of the first attachment member (to the inside widthwise to the bands) and the button unit is placed between the side walls of the first attachment member so that the push buttons pass through the openings in the side walls and protrude to the outside of the side walls of the first attachment member (to the outside widthwise to the bands).

By forming openings in the side walls of the first attachment member, this aspect of the invention enables assembling the first attachment member and button unit in unison by means of a simple construction.

In the clasp according to another aspect of the invention, the first attachment member is substantially U-shaped with the side walls rising from the opposite ends of the spine; a second opening is notched into the side walls of the first attachment member from the opposite end as the spine so that the second opening is continuous to a first opening, which is an opening through which the push button passes; the size of the second opening is smaller than the size of the first opening in the sliding direction of the coupled members; and a necked part that can be inserted to the second opening is formed in the part of the push button that protrudes from the first opening when the push button is not depressed.

To attach the first attachment member and button unit to one of the bands with this aspect of the invention, the push button is depressed, the necked part is inserted to the second opening and the push button is then pushed into the first opening so that the push button protrudes from the first opening.

To remove the first attachment member and button unit from the band, the push button is pressed to align the necked part with the second opening so that the push button can be removed from the first attachment member through the second opening.

This arrangement enables easily connecting and disconnecting the first attachment member and button unit without pushing the push button all the way inside the side walls, and thus makes attaching the first attachment member and button unit to the band easier.

In a clasp according to another aspect of the invention, the first attachment member and the button unit are connected to pivot relative to the other on a shaft unit disposed in the direction intersecting the sliding direction of the coupled members; the button unit has a pivot locking button that is urged to the outside from the inside of the coupled members in the direction intersecting the sliding direction of the coupled members and engages the side walls of the first attachment member, and a button unit frame that holds the push button, the protruding catch, and the pivot locking button; the side walls of the second attachment member have a recessed pivot locking recess in which the pivot locking button is inserted from the inside of the side walls; the pivot locking button opposes the push button or protruding catch with a gap therebetween in the direction the push button is depressed; and the gap is sized so that A is less than B where A is the distance the push button moves relative to the button unit frame when the protruding catch engages and releases the recessed strike, and B is the distance that the push button moves relative to the button unit frame when the pivot locking button engages and releases the pivot locking recess.

This aspect of the invention enables securing the first attachment member and button unit in unison by simply pivoting the first attachment member and button unit together so that the pivot locking button and pivot locking recess engage. In addition, the band can be moved lengthwise between the first attachment member and the button unit by pushing the push button in further than needed to disengage the protruding catch from the recessed strike so that the pivot locking button disengages the pivot locking recess and the first attachment member and button unit can pivot open.

By pivotably connecting the first attachment member and the button unit, this aspect of the invention enables adjusting the length of the band without disassembling the first attachment member and button unit. More particularly, usability is improved because the first attachment member and button unit are not completely disconnected from each other in order to adjust the length of the band.

Furthermore, by connecting the first attachment member and the button unit with a pivot pin, the first attachment member and button unit can be closed by a pivot action. This arrangement makes adjusting the length of the band simple.

The pivot locking button is assembled to the push button or protruding catch so that the gap therebetween satisfies the relationship between distance A and distance B described above. This prevents the pivot locking button from disengaging the pivot locking recess when the protruding catch moves inside the side wall of the second member when buckling the bands together. The pivot locking button is also prevented from disengaging the pivot locking recess when the push button is pushed in to unbuckle the bands and the protruding catch moves inside the side wall of the second member in conjunction with this movement of the push button. The first attachment member and button unit thus do not separate when the clasp is operated to buckle and unbuckle the bands.

In a clasp according to another aspect of the invention, an inclined face is formed on at least one of the end part on the first attachment member side of the pivot locking button in the pivoting direction in which the first attachment member and the button unit come together, and the end part on the button unit side of the side wall of the first attachment member in said pivoting direction. This inclined face is sloped in the direction causing a component force to work toward the inside of the side walls of the first attachment member when the first attachment member and the button unit pivot together and the pivot locking button and the side wall of the first attachment member touch.

This inclined face can be a linear taper with a constant slope, or the inclined face can be a curved surface with a slope that is not constant.

When the pivot locking button contacts the side wall of the first attachment member when the first attachment member and the button unit pivot closed, a component force of this pivot action is transferred by the incline to the pivot locking button, causing the pivot locking button to move to the inside widthwise to the band and be guided into the pivot locking recess. The first attachment member and button unit can thus be smoothly closed and locked together.

In a clasp according to another aspect of the invention an inclined face is formed on at least one of the second member side end part of the protruding catch in the sliding direction of the coupled member, and the first member side end part of the second attachment member side walls in the sliding direction of the coupled member. This inclined face is sloped in the direction causing a component force to work toward the inside of the side walls of the first attachment member when the protruding catch and the side walls of the second attachment member touch because the coupled members are slid together.

This inclined face can be a linear taper with a constant slope, or the inclined face can be a curved surface with a slope that is not constant.

When the protruding catch contacts the side wall of the second attachment member when the bands are slid together, a component force of this action is transferred by the incline and causes the protruding catch to move to the inside widthwise to the band and be guided into the recessed strike. The bands can thus be smoothly slid together and fastened.

Yet further preferably, the second member comprises a spring pin having a rod member that is inserted in a cylinder and is pushed freely to the outside by a spring, and the side walls of the second attachment member are attached by the spring pin to the other coupled member.

This aspect of the invention enables freely connecting and disconnecting the second attachment member to the band by means of the spring pin, and thus makes changing the band easy.

Yet further preferably, the push button and the protruding catch are formed as parts of a single flat member, and a notch that holds a part of a side wall of the first attachment member and a part of a side wall of the second attachment member is formed between the push button and the protruding catch.

By forming a cut-out notch in sheet material so that both sides of the notch render the push button and protruding catch, this aspect of the invention enables easily achieving an arrangement whereby the protruding catch and push button move together, and the protruding catch is inserted to the recessed strike of the second attachment member when the push button is inserted to the opening in the first attachment member.

Another aspect of the invention is a band that has the clasp of the invention described above.

By using the clasp of the invention, this aspect of the invention achieves the same action and effect described above.

Another aspect of the invention is a portable device that has the band of the invention described above.

By using the band having a clasp as described above, this aspect of the invention achieves the same action and effect described above.

Examples of the portable device include data devices, communication devices, memory cards, cameras, and measurement devices.

Another aspect of the invention is a timepiece having the band described above with the band connected to the timepiece case.

By using the band having a clasp as described above, this aspect of the invention achieves the same action and effect described above.

The band in this case is preferably a timepiece band.

The timepiece band can be made of any desirable material, including leather, cloth, plastic, and metal.

Another aspect of the invention is an accessory having the band described above so that the accessory can be worn by means of the band.

By using the band having a clasp as described above, this aspect of the invention achieves the same action and effect described above.

The invention enables easily locking and unlocking the clasp with a simple operation, and greatly improves the durability of the secured strap or other member because the clasp does not impose a load on only a part of the strap or secured member.

Other objects and attainments together with a fuller understanding of the invention will become apparent and appreciated by referring to the following description and claims taken in conjunction with the accompanying drawings.

DESCRIPTION OF PREFERRED EMBODIMENTS

Figure 1:
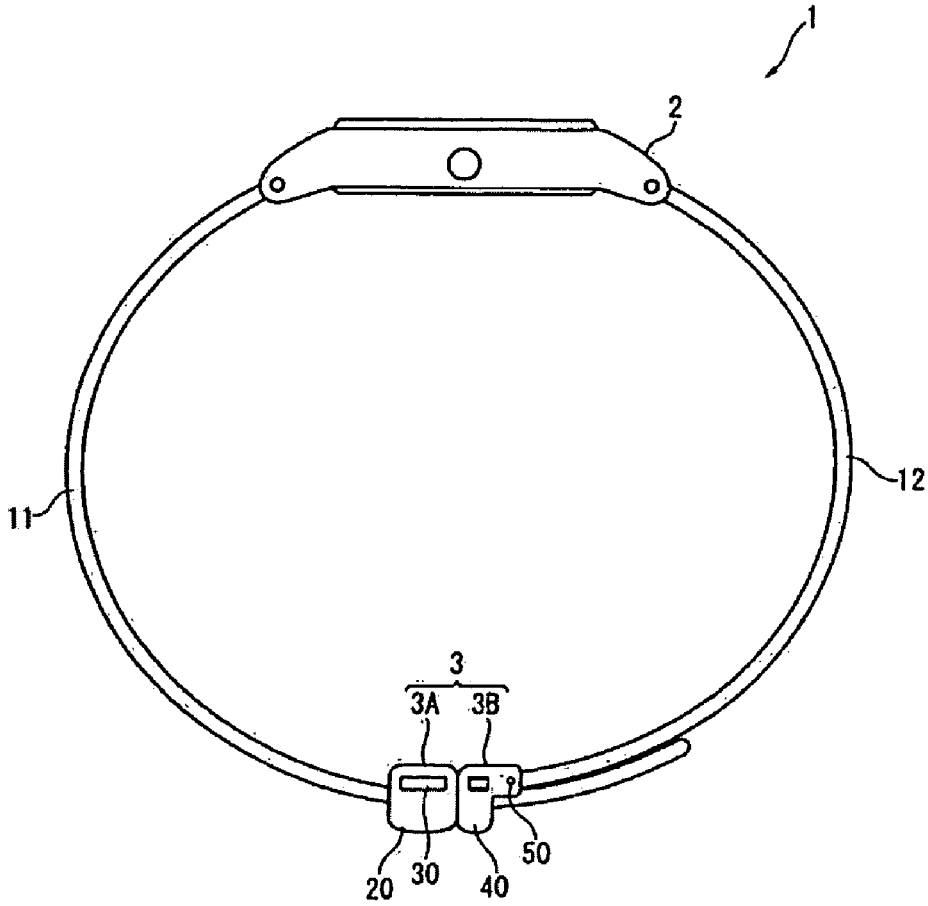
FIG. 1 is a side view of a timepiece and a timepiece band according to a first embodiment of the invention.

Preferred embodiments of the present invention are described below with reference to the accompanying figures. Note that in the second and subsequent embodiments parts that are functionally the same as parts that have already been described in the first embodiment are identified by the same reference numerals, and further description thereof is omitted.

Embodiment 1

A first embodiment of the invention is described next.

1. General Arrangement

FIG. 1 is a side view of a wristwatch 1 according to a first embodiment of the invention. The wristwatch 1 has a timekeeping unit not shown, a case 2 that houses the timekeeping unit, and leather wrist bands 11 and 12 that are respectively attached to the case 2 at the 6:00 o'clock and 12:00 o'clock positions. The free ends of the bands 11 and 12 are joined by a clasp 3.

2. Clasp

Figure 2:
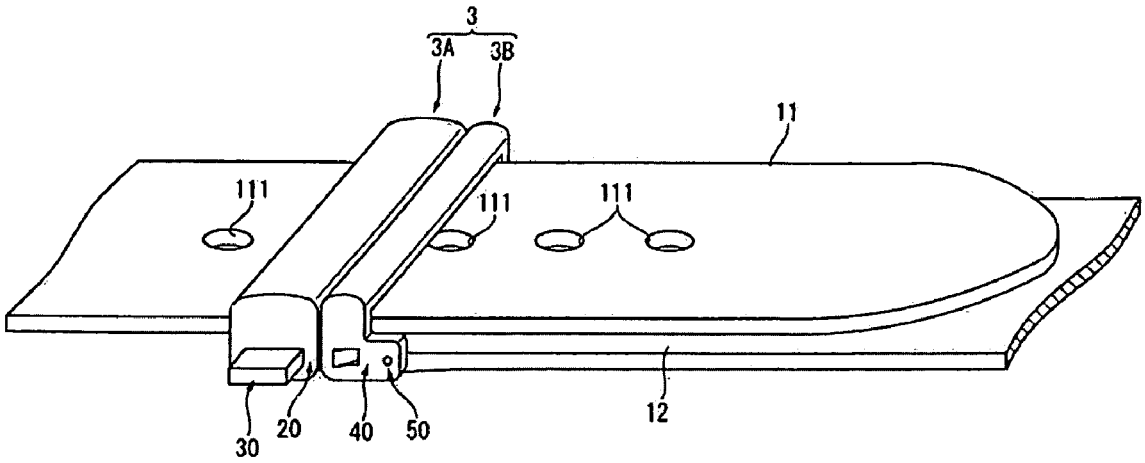
FIG. 2 is an oblique view showing the clasp of the timepiece band according to the first embodiment of the invention.
Figure 3:
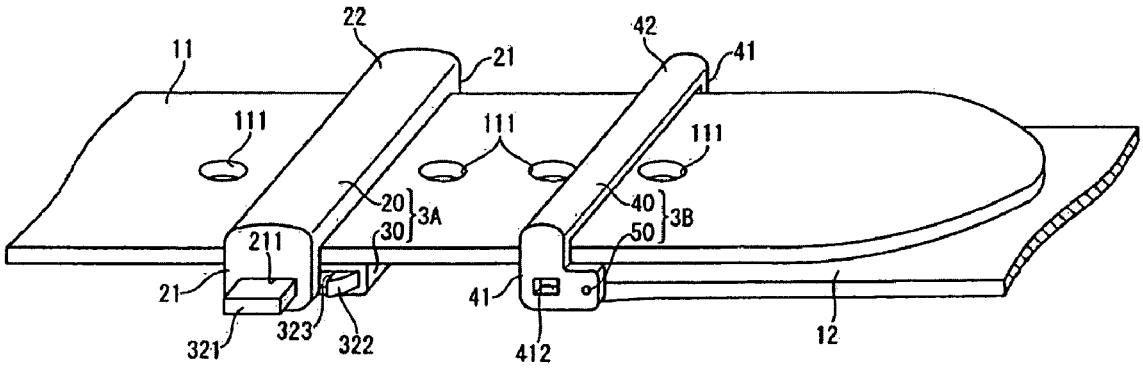
FIG. 3 shows the first member and the second member of the clasp according to the first embodiment of the invention when separated.

FIG. 2 is an oblique view of the clasp 3. The clasp 3 has a first member 3A and a second member 3B, and the bands 11 and 12 are held together by engaging the first member 3A and second member 3B with each other. The first member 3A is attached at the 6:00 o'clock position of the case 2 and has a plurality of adjustment holes 111 for adjusting the length of the band when the clasp 3 is closed. The band 12 is attached at the 12:00 o'clock position of the case 2. FIG. 2 shows the first member 3A and the second member 3B engaged so that the bands 11 and 12 are buckled together, and FIG. 3 shows the first member 3A and the second member 3B when disengaged.

The 6:00 o'clock band 11 and the 12:00 o'clock band 12 are both belt-like bands in this embodiment of the invention, but the timepiece bands that can be secured by the clasp 3 according to this embodiment of the invention are not limited to such belt-like bands and can be any appropriately configured strap.

A belt, strap, or bracelet as used herein refers to a member that has a long axis and is longer than it is wide, and includes various belt, strap, band, and other long flat configurations.

Furthermore, the timepiece band that can be fastened by the clasp 3 of the invention is not limited to such a belt or strap, and could have a block-shaped connector part that is linked to the timepiece case, and an extension part that goes from the connector part to the other side of the timepiece case, and the clasp member could be disposed to the extension part.

The 6:00 o'clock side band and the 12:00 o'clock side band also do not need to be identically shaped. For example, one band could be a belt or strap such as described above, and the other could be any desired shape other than a belt or strap.

3. First Member

As shown in FIG. 3, the first member 3A has a first attachment member 20 that is disposed across the width of the 6:00 o'clock side band 11, and a button unit 30. The 6:00 o'clock band 11 is disposed between the first attachment member 20 and the button unit 30, and the button unit 30 has a push button 321.

3-1. First Attachment Member

Figure 4:
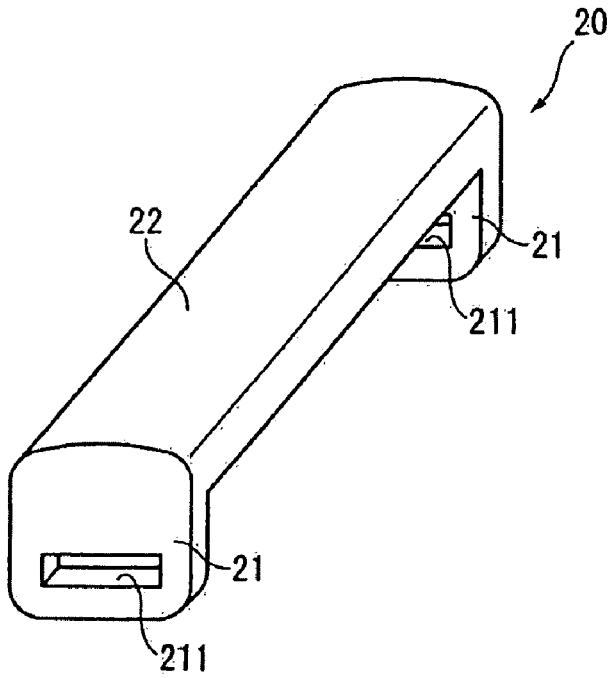
FIG. 4 is an oblique view of the first attachment member of the first member.

FIG. 4 shows the first attachment member 20. The first attachment member 20 is basically U-shaped with a spine 22 (connecting member) and two side walls 21 that extend through the thickness of the band 11 from the ends of the spine 22 on the opposite sides of the width of the band 11 (FIG. 3). A substantially rectangular opening 211 is formed passing through each of the side walls 21.

3-2. Button Unit

Figure 5:
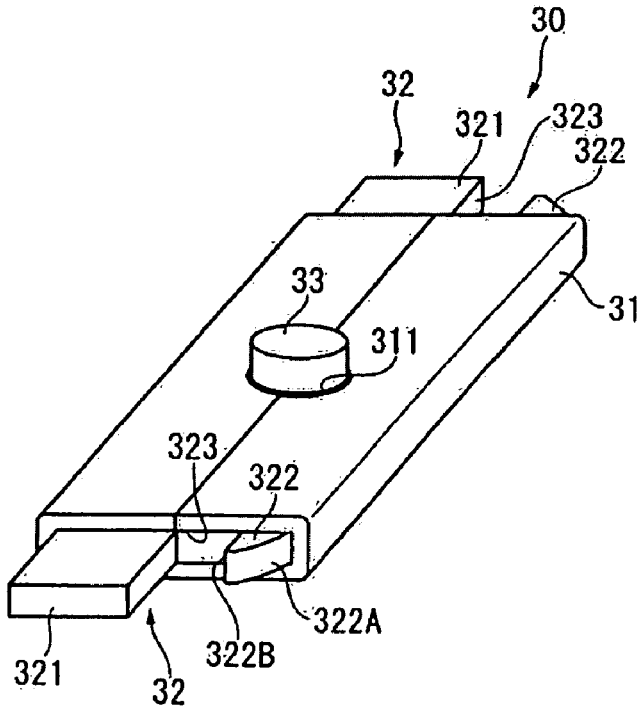
FIG. 5 is an oblique view of the button unit of the first member.
Figure 6:
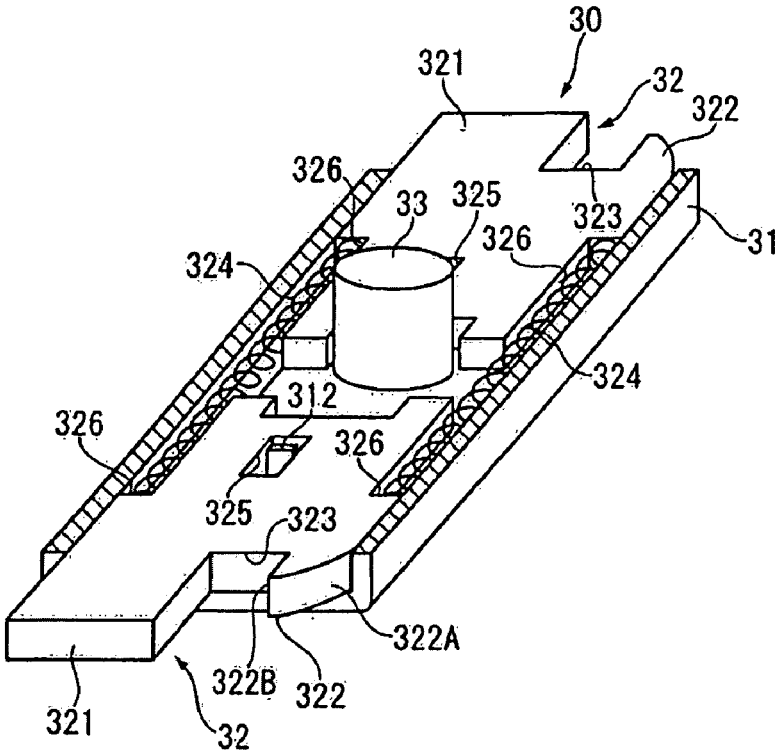
FIG. 6 shows the internal arrangement of the button unit.
Figure 7:
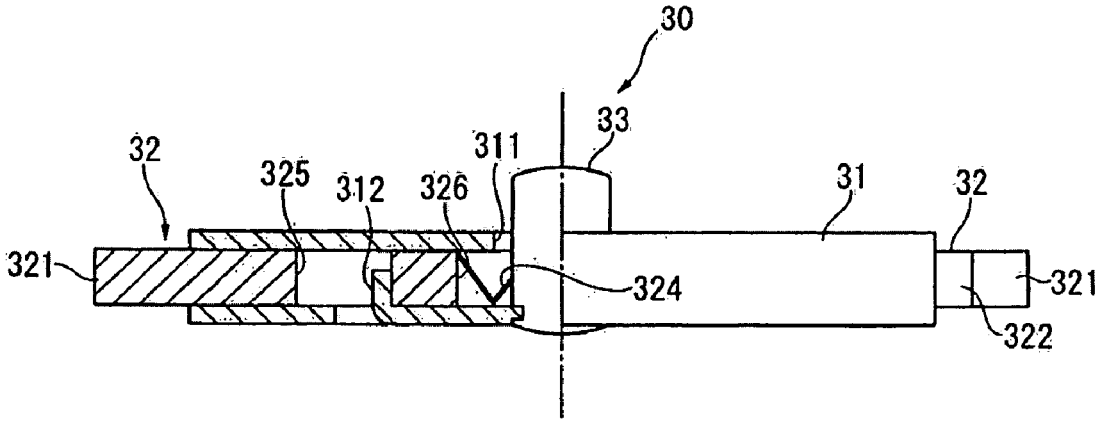
FIG. 7 is a partial side section view of the button unit.

FIG. 5 shows the button unit 30. FIG. 6 shows the inside of the button unit 30, and FIG. 7 is a partial side section view of the button unit 30. FIG. 6 shows the button unit 30 with part of a button unit frame 31 removed.

As shown in FIG. 5 and FIG. 6, the button unit 30 has the button unit frame 31 that is disposed between the side walls 21 of the first attachment member 20 shown in FIG. 4, button members 32 protruding from openings at the opposite ends of the button unit frame 31, and a stud 33 that is fixed to the bottom of the button unit frame 31 and protrudes from the top of the button unit frame 31.

The button unit frame 31 is formed with a substantially rectangular section as shown in FIG. 5 by bending and shaping a thin metal sheet, and a hole 311 through which the stud 33 passes is formed where the edges of the thin sheets join.

A stopper 312 for stopping each of the button members 32 is formed by raising a tab for each from the bottom of the button unit frame 31 as shown in FIG. 6 and FIG. 7.

As shown in FIG. 6, each button member 32 is a flat member having a push button 321 and a protruding catch 322 formed in unison with a notch 323 therebetween. The button members 32 are urged to the outside from the inside of the opposite end openings in the button unit frame 31 by corresponding coil springs 324. The button members 32 are engaged with the button unit frame 31 by inserting the corresponding stopper 312 into a through-hole 325 formed in each of the button members 32.

Notches 326 are formed in the button members 32 along both sides of button unit frame 31, and the coil springs 324 are disposed in these notches 326 between the button members 32.

The push button 321 is flat and rectangularly shaped, and protrudes to the outside from the inside of an opening 211 formed in the side wall 21 of the first attachment member 20 (FIG. 4). The thickness of the push button 321 is slightly less than the height of the opening 211, and the width is slightly less than the width of the opening 211.

The through-holes 325 in which the stoppers 312 are inserted are sized so that when both push buttons 321 are squeezed together and pushed to the inside across the width of the band 11 (FIG. 3), the distance between the distal ends of the push buttons 321 is less than the distance between the inside faces of the side walls 21, and the push buttons 321 separate from the openings 211 when the push buttons 321 are pushed in to the maximum inside position.

When the push buttons 321 are not pushed in against the force of the compressed coil springs 324, the spring force of the coil springs 324 preferably causes the stopper 312 to contact the inside end wall of the through-hole 325. This eliminates any play in the push button 321.

The catches 322 protrude in the direction of the urging force of the coil springs 324 at positions not overlapping the side walls 21 of the first attachment member 20 (FIG. 4). The part of the catch 322 on the button unit frame 31 side is a curved incline 322A formed at an angle to both the length and the width of the band 11 (FIG. 3). The rise 322B of the catch 322 on the notch 323 side is substantially perpendicular to the length of the band 11.

The stud 33 is a round column substantially equal in diameter to the diameter of the adjustment holes 111 in the band 11 (FIG. 3), and is crimped to the bottom of the button unit frame 31. Attaching the stud 33 is not limited to crimping, however, and the stud 33 could be fixed to the bottom of the button unit frame 31 by laser welding, for example. The stud 33 protrudes from the top of the button unit frame 31 and is inserted to one of the adjustment holes 111 in the band 11, but the height of the stud 33 does not need to equal the thickness of the band 11.

3-3. Attaching the First Member to the Band

Figure 8:
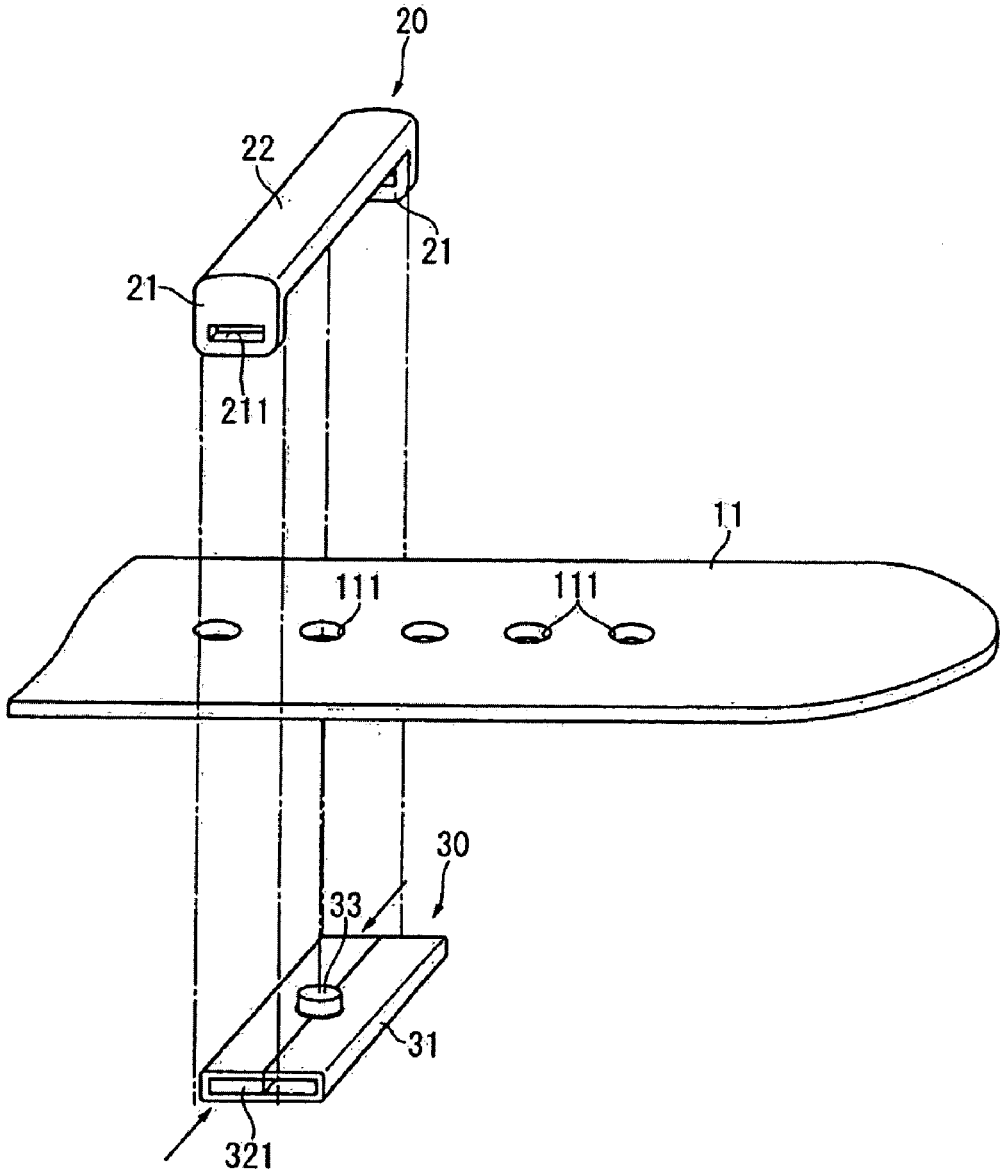
FIG. 8 shows attaching the first attachment member and the button unit to the 6:00 o'clock side band.
Figure 9:
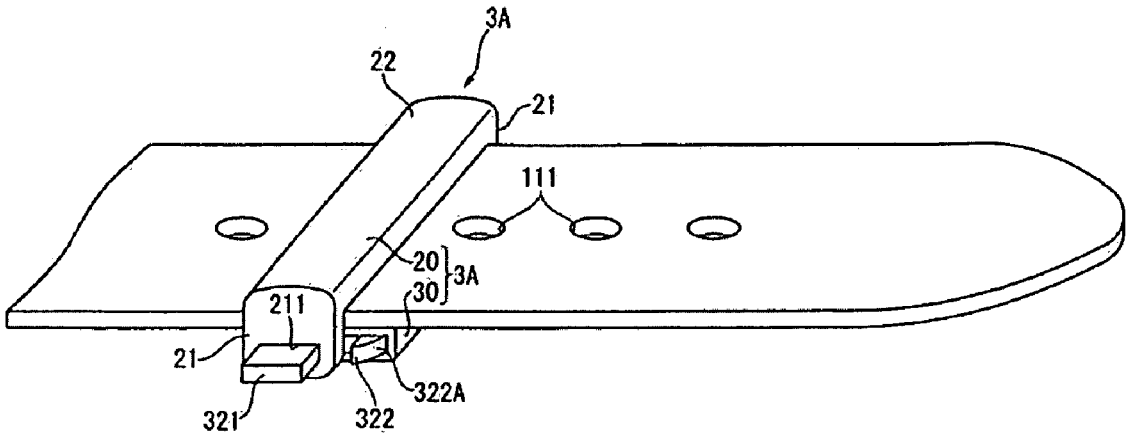
FIG. 9 shows the first attachment member and the button unit when attached to the 6:00 o'clock side band.

FIG. 8 and FIG. 9 illustrate attaching the first attachment member 20 and the button unit 30 to the 6:00 o'clock side band 11. The first attachment member 20 is positioned to the top side of the band 11, the button unit 30 is positioned on the back side of the band 11 in contact with the wrist, and the band 11 is disposed between the first attachment member 20 and the button unit 30. The first attachment member 20 and the button unit 30 are attached to the band 11 at a specific adjustment hole 111 selected according to the desired length of the band when the clasp is closed.

To attach the first attachment member 20 and button unit 30 to the band 11, the stud 33 is inserted to a particular adjustment hole 111 as shown in FIG. 8, both push buttons 321 are squeezed together to the inside widthwise to the band 11 as the button unit 30 is inserted between the side walls 21 so that the push buttons 321 then protrude to the outside from the openings 211 in the side walls 21 as shown in FIG. 9.

Because the band 11 is between the first attachment member 20 and the button unit 30, and the stud 33 is inserted to the adjustment hole 111 between the first attachment member 20 and the button unit 30, the stud 33 does not escape from the adjustment hole 111 and the planar position of the band 11 to the first attachment member 20 and the button unit 30 is fixed. More specifically, the first attachment member 20 and the button unit 30 are fixed at a specific position to the band 11.

To adjust the position of the first attachment member 20 and button unit 30 on the band 11, the push buttons 321 are squeezed together to the inside of the side walls 21 to disengage the openings 211. The stud 33 is then repositioned in a different adjustment hole 111 in the band 11, and the push buttons 321 are again squeezed together to reinsert the button unit 30 so that the push buttons 321 again protrude from the openings 211.

4. Second Member

The arrangement of the second member 3B that is attached to the 12:00 o'clock side band 12 (FIG. 3) is described next.

Figure 10:
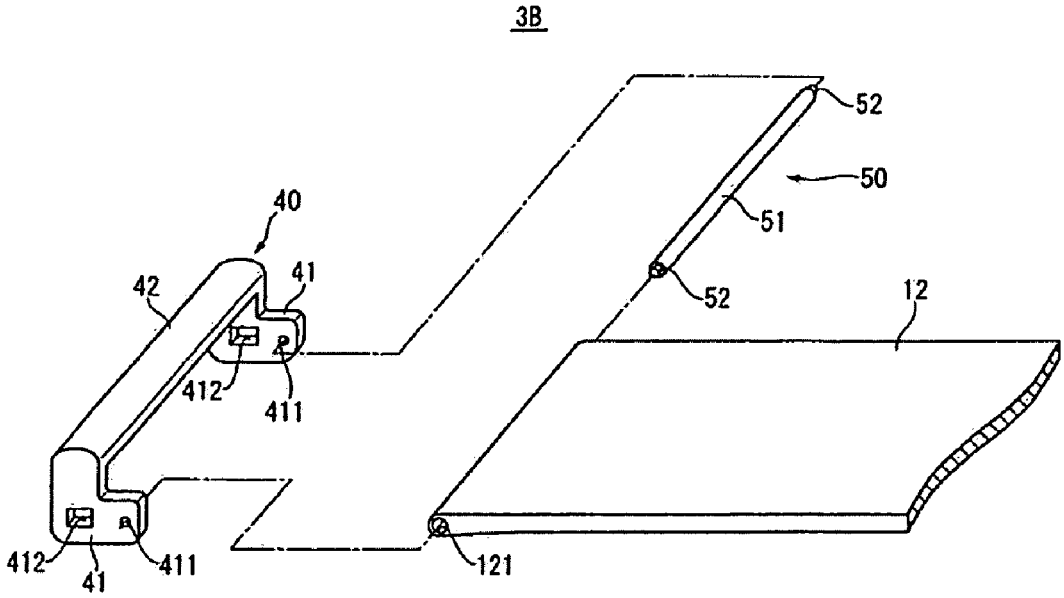
FIG. 10 is an oblique view of the second member.

FIG. 10 is an oblique view of the second member 3B. The second member 3B has a second attachment member 40 and a spring pin 50. The second attachment member 40 is basically U-shaped in section and is attached to the 12:00 o'clock side band 12.

The spring pin 50 has a cylinder 51 and catch pins 52. The cylinder 51 is passed through a hole 121 formed by wrapping the leather at the end of the band 12 back on itself. The catch pins 52 are inserted to the opposite ends of the cylinder 51 and are pushed to the outside from the ends of the cylinder 51 by a spring disposed inside the cylinder 51.

The second attachment member 40 is substantially U-shaped in section and has a spine 42 connecting two side walls 41. The side walls 41 extend from the ends of the spine 42 through the thickness of the band 12 on opposite sides of the width of the band 12. The spine 42 spans the width of the band 12 on the front between the side walls 41. Note that the middle part of the spine 42 is a curved convex surface protruding to the outside similarly to the spine 22 of the first attachment member 20.

A hole 411 that engages the catch pin 52 of the spring pin 50, and a strike recess 412 that captures the catch 322 of the button unit 30 (FIG. 9) inserted thereto, are formed in each of the side walls 41.

Figure 11:
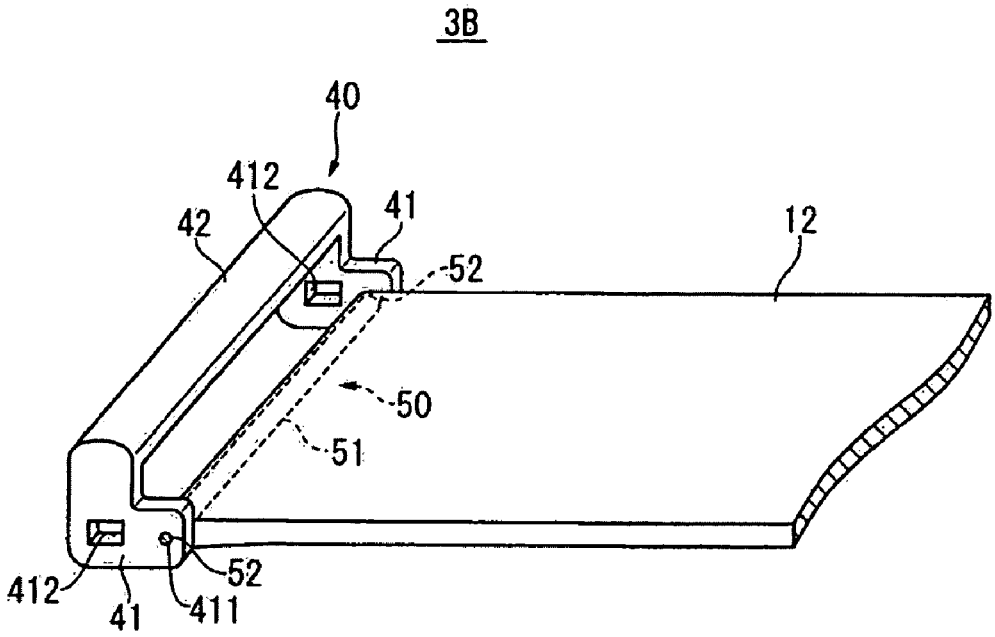
FIG. 11 shows the second member attached to the 12:00 o'clock side band.

FIG. 11 shows the second attachment member 40 attached to the band 12 by means of the spring pin 50. When the second attachment member 40 is attached to the band 12, the spring pin 50 is passed through the hole 121 in the band 12, the catch pins 52 are pushed inside the cylinder 51 as the spring pin 50 is positioned between the opposing side walls 41 of the second attachment member 40, and the catch pins 52 are then caused to engage the holes 411 in the side walls 41.

5. Securing the Band by Means of the Clasp

The operation for fastening the bands 11 and 12 with the clasp 3 and attaching the wristwatch 1 on the wrist (as an example of where the wristwatch 1 is worn) is described next with reference to FIG. 12 to FIG. 14.

Figure 12:
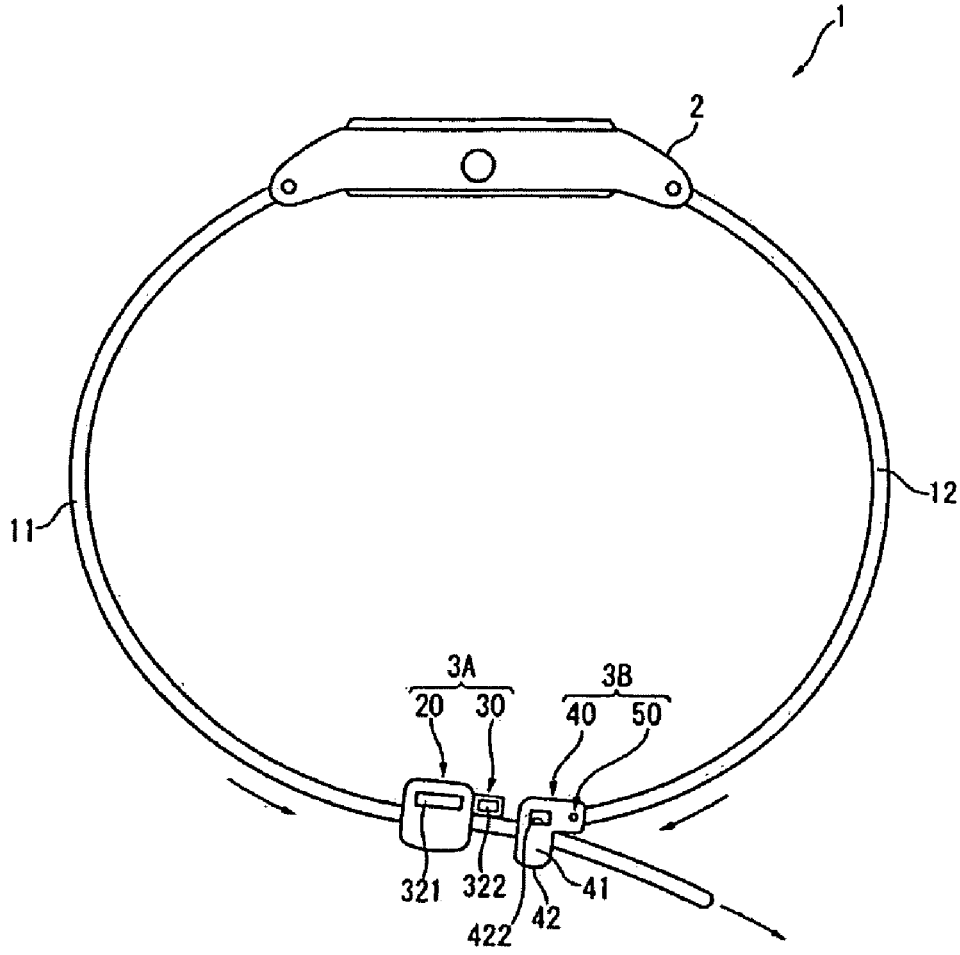
FIG. 12 shows buckling the bands with the clasp according to this embodiment of the invention.
Figure 13:
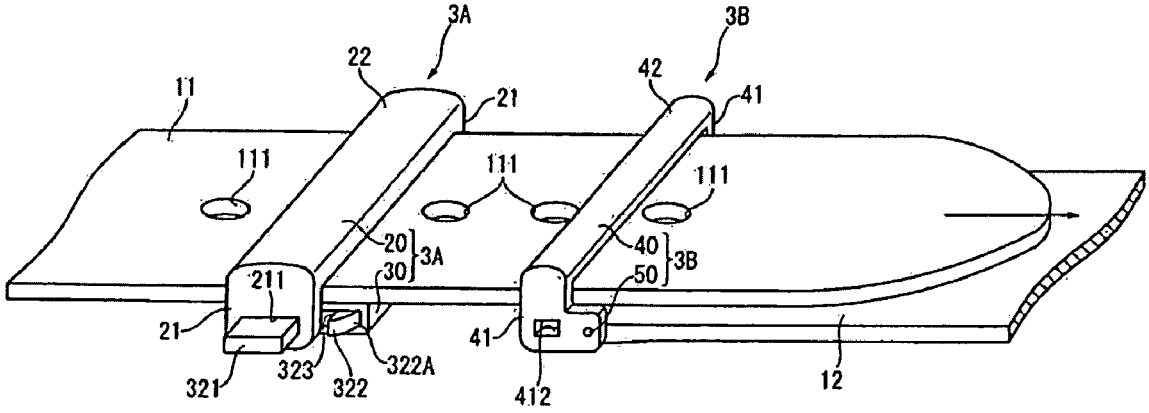
FIG. 13 shows buckling the bands with the clasp according to this embodiment of the invention.
Figure 14:
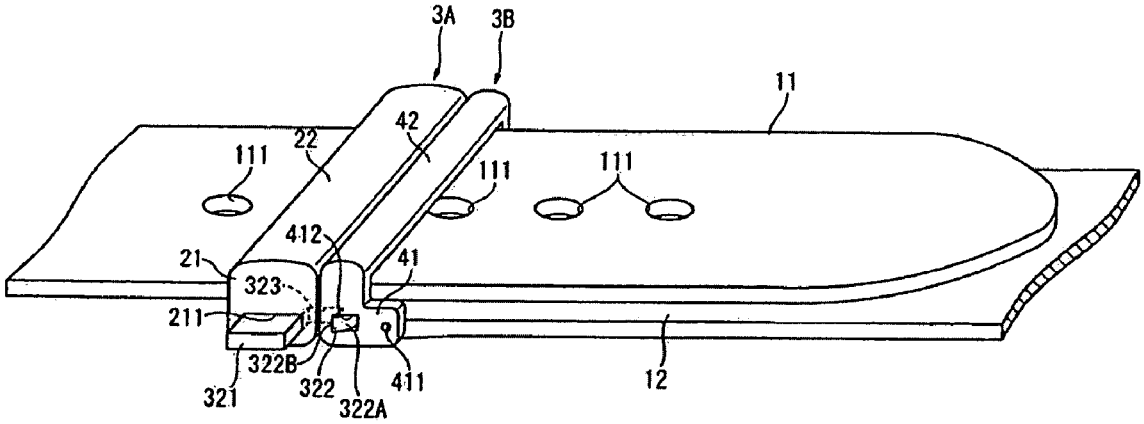
FIG. 14 shows the bands when buckled together by the clasp according to this embodiment of the invention.

FIG. 12 is a side view of the wristwatch 1 according to this embodiment of the invention, and FIG. 13 shows sliding the 6:00 o'clock side band 11 lengthwise (in the direction of the arrow). When the end part of the 6:00 o'clock side band 11 is inserted between the spine 42 of the second attachment member 40 and the 12:00 o'clock side band 12, and the end part of the 6:00 o'clock side band 11 is then pulled as shown in FIG. 12 and FIG. 13, the 6:00 o'clock side band 11 and the 12:00 o'clock side band 12 slide relative to each other in opposite lengthwise directions so that the ends come together. The spine 42 of the second attachment member 40 functions as a guide, and the 6:00 o'clock side band 11 is guided along the length of the band 11 between the side walls 41 of the second attachment member 40.

When the 6:00 o'clock side band 11 is thus slid relative to the 12:00 o'clock side band 12, the first member 3A and the second member 3B come together, the catches 322 of the button unit 30 engage the strike recesses 412 in the side walls 41 of the second attachment member 40 from the inside surface of the side walls 41, and the bands 11 and 12 are thus coupled together.

As a result of this sliding action of the 6:00 o'clock side band 11, the incline 322A of each catch 322 contacts the side wall 41, the component force of the force acting longitudinally to the band 11 pushes the catch 322 to the inside widthwise to the band 11, and the catch 322 is guided smoothly into the strike recess 412 in the side walls 41. The bands 11 and 12 are thus coupled together as a result of the catches 322 being inserted to the strike recesses 412 from the inside side of the side walls 41.

When the bands 11 and 12 are thus coupled, part of the side walls 21 of the first attachment member 20 and part of the side walls 41 of the second attachment member 40 are held in the notches 323 between the push buttons 321 and the catches 322. More specifically, the width of the notch 323 is slightly greater than the distance from the edge of the opening 211 to the edge of the side wall 21 along the length of the bands 11 and 12, plus the distance from the edge of the strike recess 412 to the edge of the side wall 21 along the length of the bands 11 and 12.

Furthermore, because the rise 322B of the catch 322 is substantially perpendicular to the length of the band 11, the catch 322 does not easily accidentally disengage the strike recess 412 even when a pulling force is applied lengthwise to the bands 11 and 12.

To unbuckle the bands 11 and 12, the push buttons 321 are squeezed together to the inside across the width of the band 11, and the bands 11 and 12 are slid apart. Because squeezing the push buttons 321 together causes the catches 322 to move to the inside widthwise to the band 11 and disengage the strike recesses 412, the bands 11 and 12 can be slid in the directions causing the first member 3A and second member 3B to separate. Note that tensile force produced by the rigidity of the bands 11 and 12 enables the bands 11 and 12 to separate by simply depressing the push buttons 321, and there is no need to intentionally slide the bands 11 and 12 apart.

6. Effect of the Invention

This embodiment of the invention has the effects described below.

(1) The clasp 3 of the wristwatch bands 11 and 12 has a first member 3A and a second member 3B attached to specific positions on the bands 11 and 12, and simply sliding the bands 11 and 12 together in the closing direction causes the catches 322 to engage the strike recesses 412 so that the bands 11 and 12 are fastened together. The bands 11 and 12 can therefore be easily buckled together at the desired band length whenever the band is put on.

The bands 11 and 12 can also be easily unbuckled and separated by simply depressing the push buttons 321 and sliding the bands 11 and 12 apart.

The bands 11 and 12 can thus be easily coupled and uncoupled by simply sliding the bands 11 and 12 in the appropriate directions, a load is not locally applied to a part of the bands 11 and 12, and the durability of the bands 11 and 12 is thus improved.

(2) By inserting the 6:00 o'clock side band 11 between the first attachment member 20 and the button unit 30, and inserting the stud 33 to an adjustment hole 111 in the band 11 between the first attachment member 20 and the button unit 30, the first attachment member and the button unit can be reliably attached to the band at a specific desired position.

(3) By forming an incline 322A on the catch 322 so that a component force acting on the incline 322A causes the catch 322 to be inserted smoothly to the strike recess 412, the sliding action of the band 11 is rendered even easier.

(4) Because the second member 3B can be disassembled into the second attachment member 40 and the spring pin 50, the band 12 can be easily replaced.

(5) Because the second attachment member 40 has a spine 42 underneath which the band 11 is passed so that pulling on the band 11 causes the bands 11 and 12 to slide together in opposite directions, the bands 11 and 12 can be easily buckled together using a single hand.

Variation of Embodiment 1

A variation of the foregoing first embodiment is described next with reference to FIG. 15 to FIG. 17.

Figure 15:
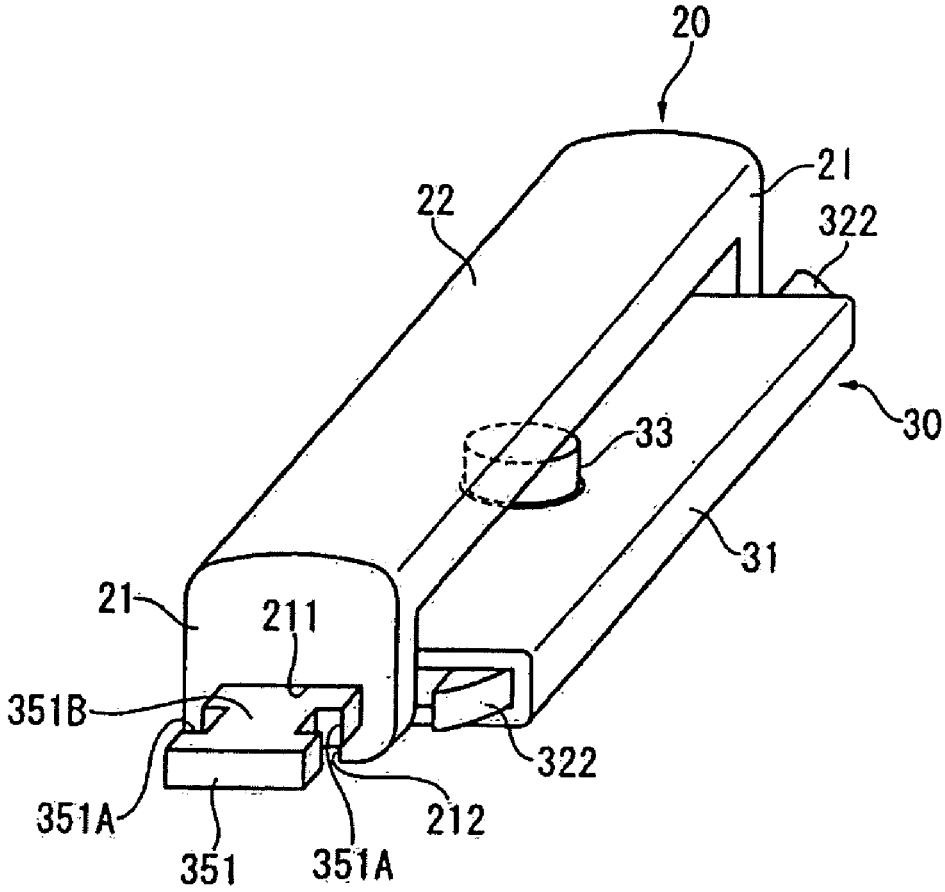
FIG. 15 shows the first member according to a variation of the first embodiment.

FIG. 15 shows the first member according to this variation that is attached to the 6:00 o'clock side band 11 (FIG. 9). The first member 3A shown in FIG. 9 can be replaced with the first member shown in FIG. 15.

Figure 16:
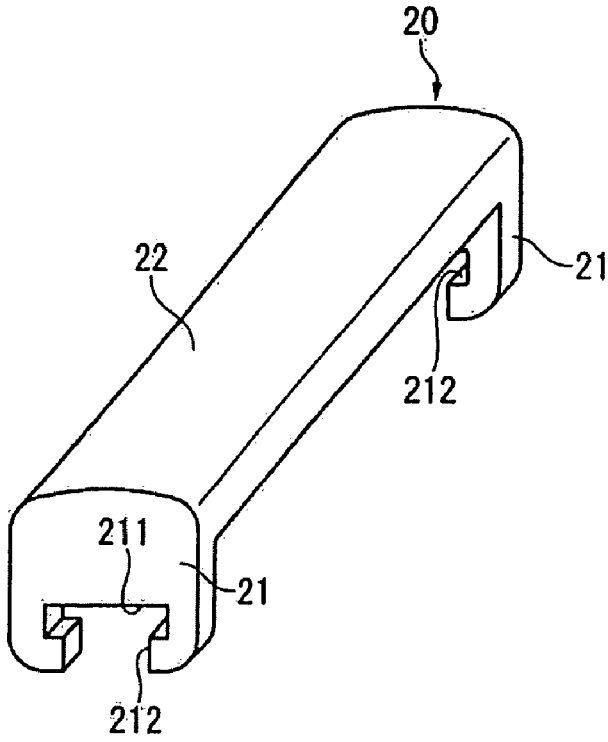
FIG. 16 shows the first attachment member of the first member in this first variation.

As shown in FIG. 16, this variation of the invention has a second opening 212 formed contiguously to the first opening 211 in each of the side walls 21 of the first attachment member 20. The second opening 212 is formed by notching the side wall 21 at the opposite side as the spine 22, and the width of the second opening 212 along the length of the band 11 is less than the width of the first opening 211 along the length of the band 11.

Figure 17:
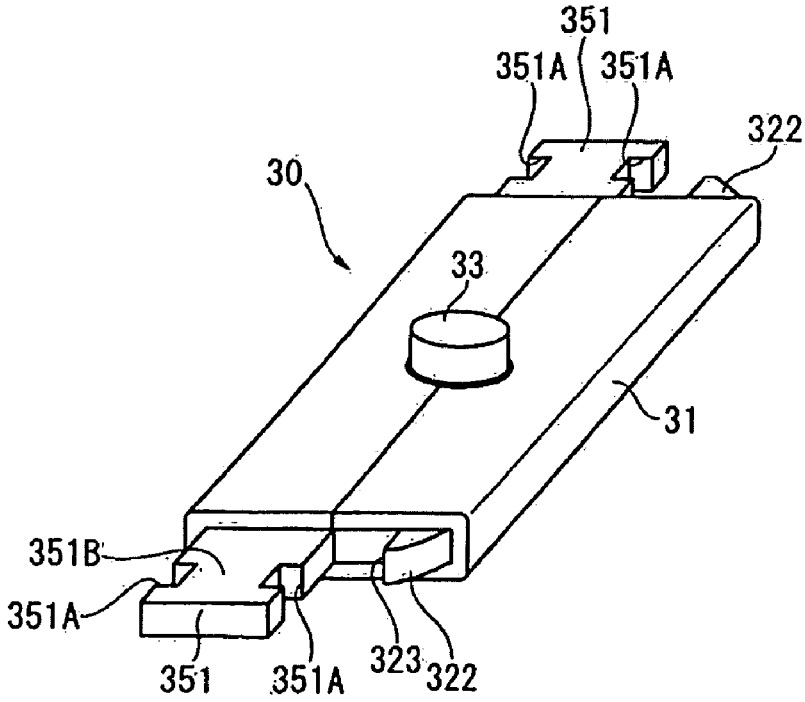
FIG. 17 shows the button unit of the first member in the first variation.

As shown in FIG. 17, a neck 351B is formed in the part of the push button 351 that protrudes from the first opening 211 (FIG. 16) by forming a pair of notches 351A in both sides in line with the length of the band 11. The width of the notches 351A (the dimension in line with the width of the band 11) is slightly greater than the thickness of the side walls 21 of the first attachment member 20, and the depth of the notches 351A (the dimension in line with the length of the band 11) is slightly greater than ½ the difference of the size of the first opening 211 and the size of the second opening 212 in line with the length of the band 11.

To attach the first attachment member 20 and the button unit 30 to the band 11 in this variation of the invention, the push buttons 351 are depressed until the notches 351A align with the second openings 212 to insert the necks 351B to the second openings 212, and the push buttons 351 are then pushed into the first openings 211. When the push buttons 351 are then released, the push buttons 351 protrude from the first openings 211.

To remove the first attachment member 20 and the button unit 30 from the band 11, the push buttons 351 are depressed to align the notches 351A with the second openings 212, and the push buttons 351 are then removed from the first openings 211 through the second openings 212.

With this variation of the invention the first attachment member 20 and the button unit 30 can be easily engaged and disengaged without pushing the push buttons 351 all the way in so that the push buttons 351 are pushed all the way to the inside of the side walls 21. This makes it easier to adjust the size of the band to the user both at the time of purchase in the store and later by the user.

Embodiment 2

A second embodiment of the invention is described next with reference to FIG. 18 to FIG. 25. In the first embodiment as shown in FIG. 2 and FIG. 3 bands 11 and 12 are buckled together with the 12:00 o'clock side band 12 on the bottom (touching the wrist) and the 6:00 o'clock side band 11 on top of the 12:00 o' clock side band 12. This arrangement is reversed in this second embodiment of the invention and the bands 11 and 12 are buckled together with the 6:00 o'clock side band 11 on the bottom (touching the wrist) and the 12:00 o'clock side band 12 on top.

Figure 18:
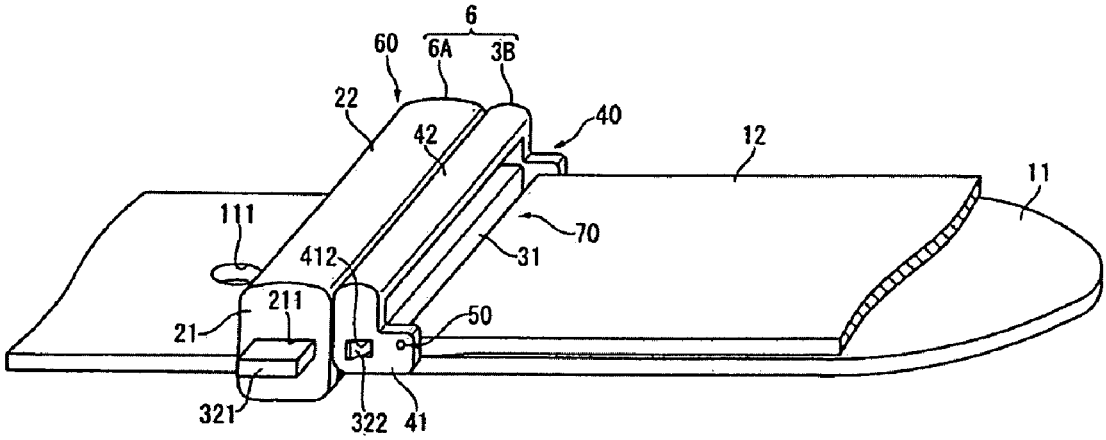
FIG. 18 is an oblique view showing the clasp of the timepiece band according to a second embodiment of the invention.

FIG. 18 shows the clasp 6 according to this embodiment of the invention. The clasp 6 has a first member 6A and the second member 3B described in the first embodiment.

Figure 19:
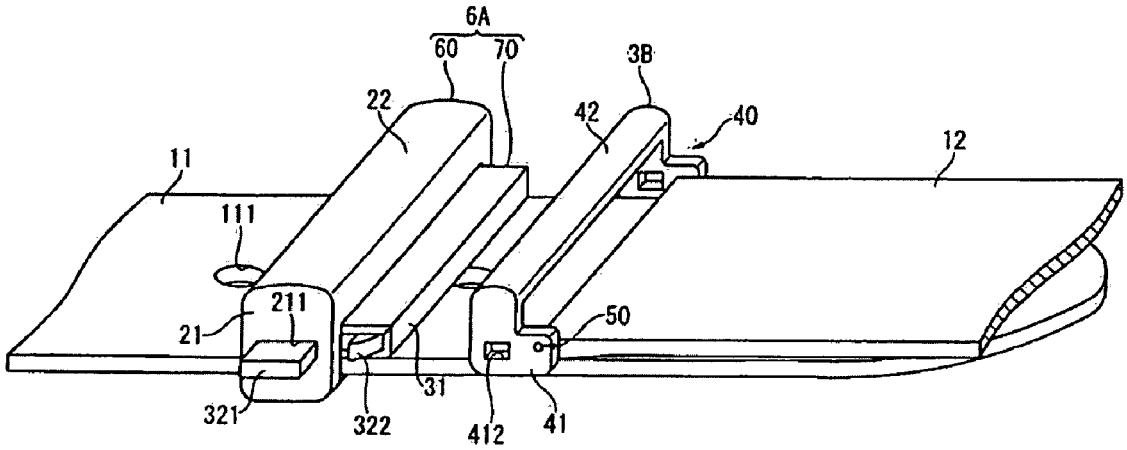
FIG. 19 shows the first member and the second member of the clasp according to the second embodiment of the invention when separated.
Figure 20:
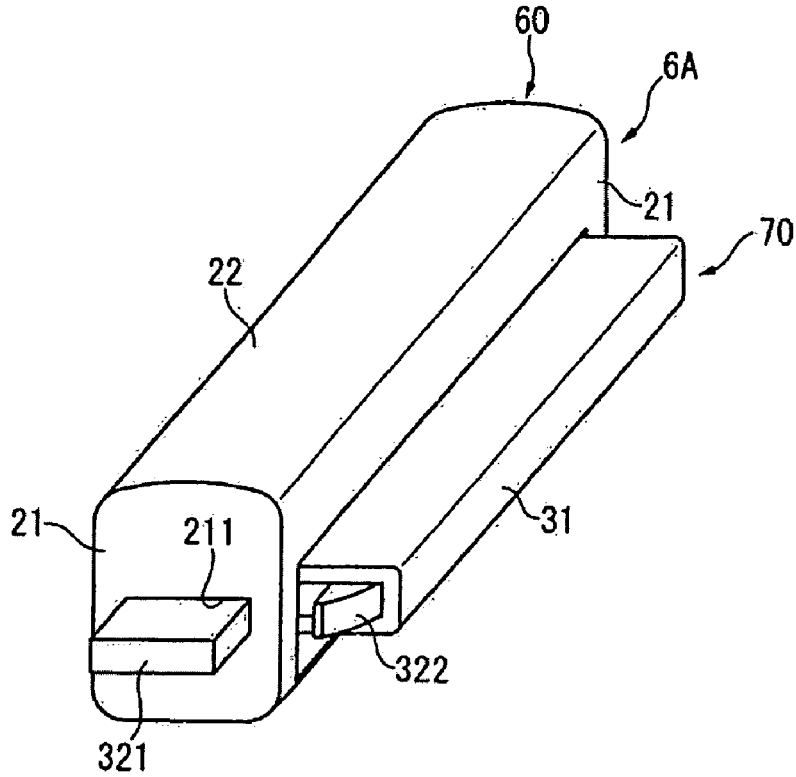
FIG. 20 is an oblique view of the first member.

FIG. 19 shows the first member 6A and second member 3B when unbuckled, and FIG. 20 shows the first member 6A.

The first member 6A includes a first attachment member 60 and a button unit 70. The first attachment member 60 is disposed across the width of the 6:00 o'clock side band 11, and the button unit 70 is disposed so that the 6:00 o'clock side band 11 is between the button unit 70 and the first attachment member 60.

Figure 21:
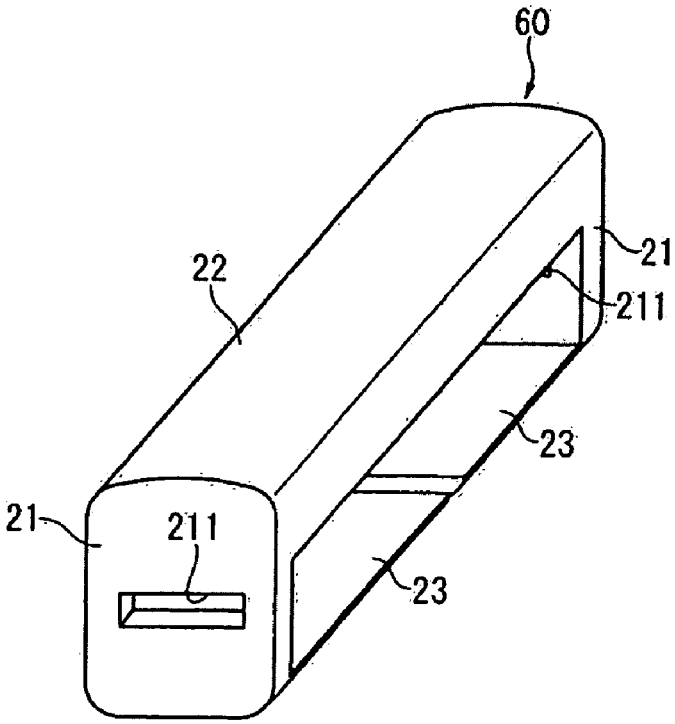
FIG. 21 is an oblique view of the first attachment member of the first member.

FIG. 21 shows the first attachment member 60. The first attachment member 60 is substantially rectangular in section, and has a pair of side walls 21 disposed on the opposite sides of the width of the band 11, a spine 22 that connects the side walls 21 on the front side of the band 11, and extensions 23 that continue on the back side of the band 11 from the ends of the side walls 21 to the inside of the width of the band 11.

Figure 22:
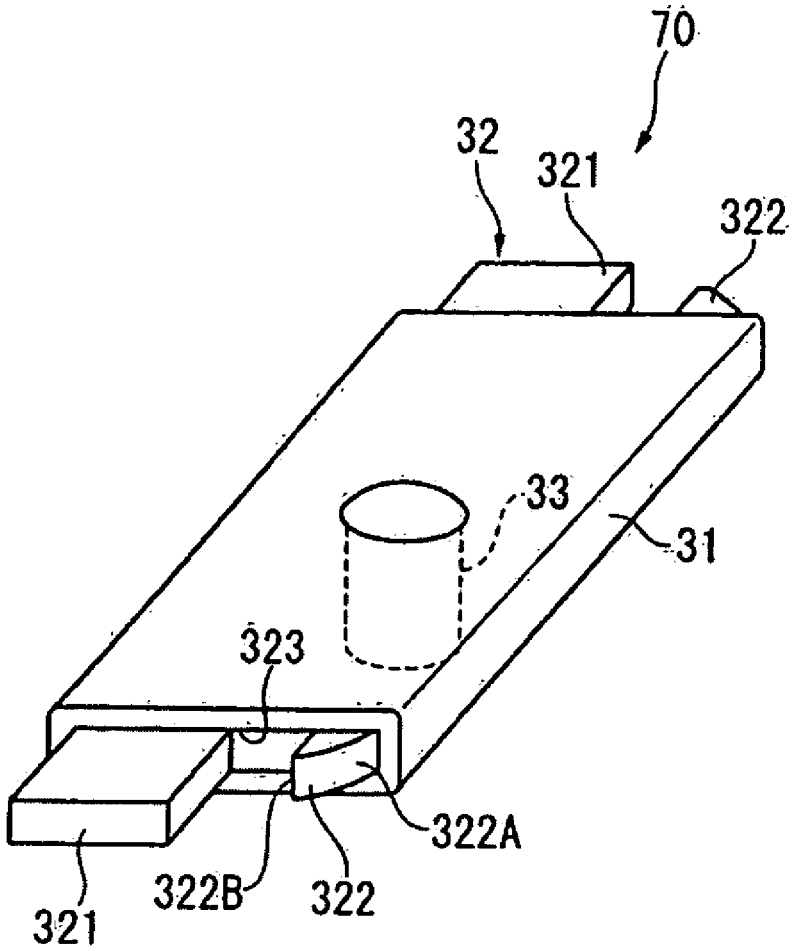
FIG. 22 is an oblique view of the button unit of the first member.

FIG. 22 shows the button unit 70. The button unit 70 has the same button unit frame 31, button members 32, and stud 33 as the button unit 30 described in the first embodiment (see FIG. 5). This button unit 70 differs, however, in that the top and bottom orientation of the button unit frame 31 is reversed from the button unit 30 in the first embodiment so that the bottom on which the stud 33 is disposed in the first embodiment is the top, and the stud 33 disposed to the button unit frame 31 protrudes downward (toward the wrist).

Figure 23:
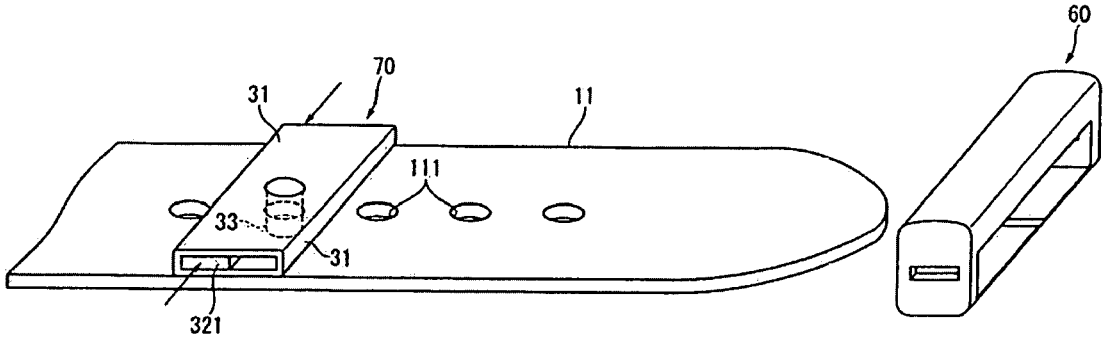
FIG. 23 shows attaching the first attachment member and the button unit to the 6:00 o'clock side band.
Figure 24:
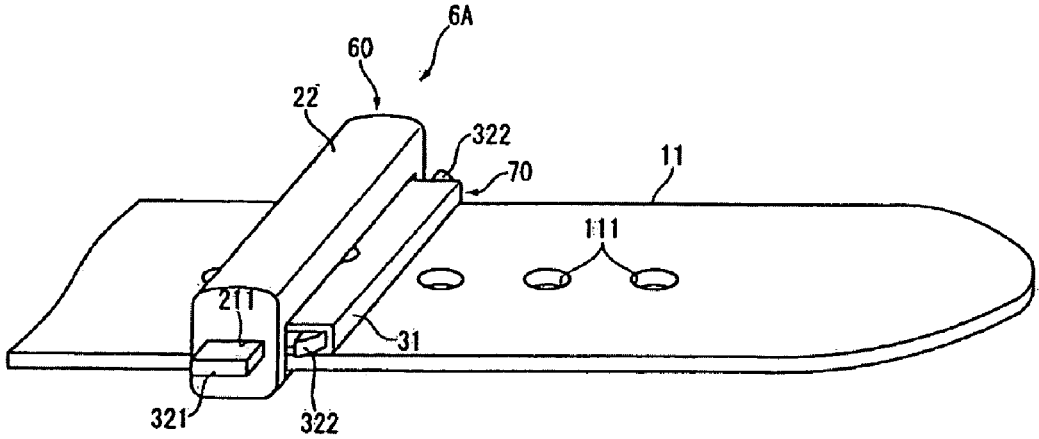
FIG. 24 shows the first attachment member and the button unit when attached to the 6:00 o'clock side band.

FIG. 23 and FIG. 24 show attaching the first attachment member 60 and the button unit 70 to the band 11.

As shown in FIG. 23 the stud 33 of the button unit 70 is inserted to one of the adjustment hole 111 of the band 11, the push buttons 321 are squeezed together to the inside widthwise to the band 11, and the button unit 70 and the band 11 are together inserted to the first attachment member 60. As a result, the push buttons 321 protrude through the openings 211 in the first attachment member 60, and the band 11 is held between the extensions 23 of the first attachment member 60 (FIG. 21) and the button unit frame 31.

Figure 25:
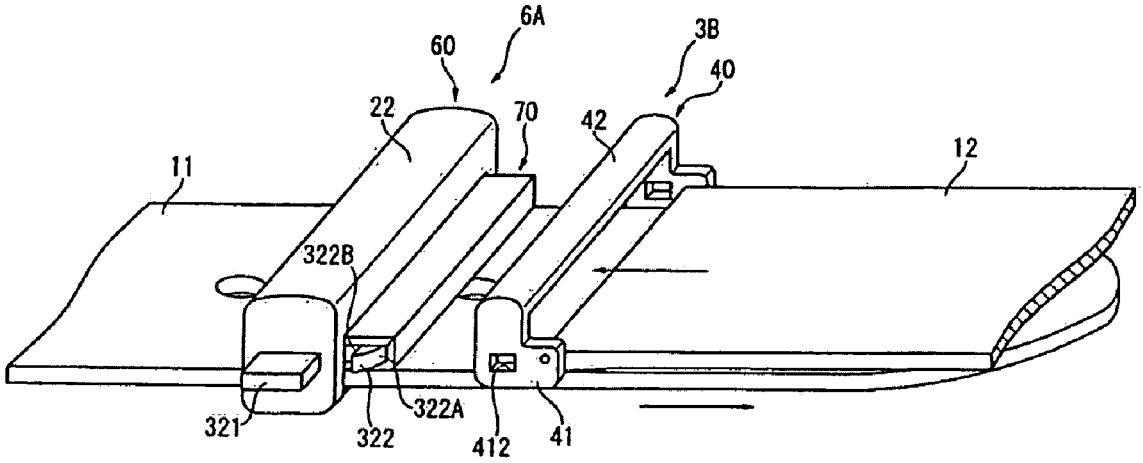
FIG. 25 shows buckling the bands with the clasp according to this embodiment of the invention.

Buckling the bands 11 and 12 together is described next with reference to FIG. 25. In this embodiment the second attachment member 40 is placed over the top of the 6:00 o'clock side band 11, the spine 22 of the first attachment member 60 and the spine 42 of the second attachment member 40 are then held respectively with the thumb and index finger, for example, and the first attachment member 60 and the second attachment member 40 are squeezed together. This causes the bands 11 and 12 to slide in opposite directions together, and causes the catches 322 of the button unit 70 to enter the strike recesses 412 of the second attachment member 40 and thus hold the bands 11 and 12 together as shown in FIG. 18. As described in the first embodiment, the inclines 322A formed on the catches 322 enable the catches 322 to be inserted smoothly to the strike recesses 412 without interference from the side walls 41.

To unbuckle the bands 11 and 12, the push buttons 321 are simply pushed to the inside of the width of the band 11 as described in the first embodiment so that the catches 322 disengage the strike recesses 412, allowing the bands 11 and 12 to separate of their own weight without the user needing to slide them apart.

In addition to the effects of the first embodiment described in (1) to (4) above, this embodiment of the invention also has the following effect.

(6) The first attachment member 60 and the second attachment member 40 each have a spine 22, 42 spanning the width of the bands 11 and 12, and the bands 11 and 12 are slid together and apart with the second attachment member 40 on top of the band 11, thereby enabling pulling the spines 22 and 42 together. As a result, the bands 11 and 12 can be easily fastened together using one hand.

Embodiment 3

A third embodiment of the invention is described next with reference to FIG. 26 to FIG. 32. This embodiment makes adjusting the length of the band easier, and is characterized by the arrangement of the first member pivotably joining the first attachment member and the button unit.

Figure 26:
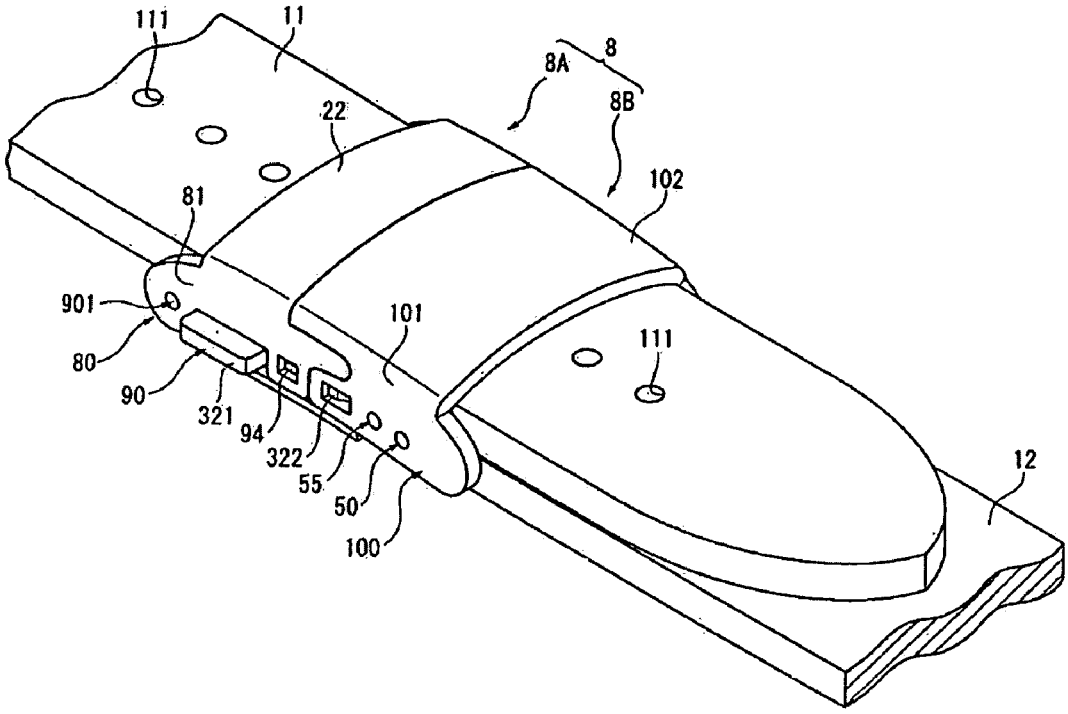
FIG. 26 is an oblique view showing the clasp of the timepiece band according to a third embodiment of the invention.
Figure 27:
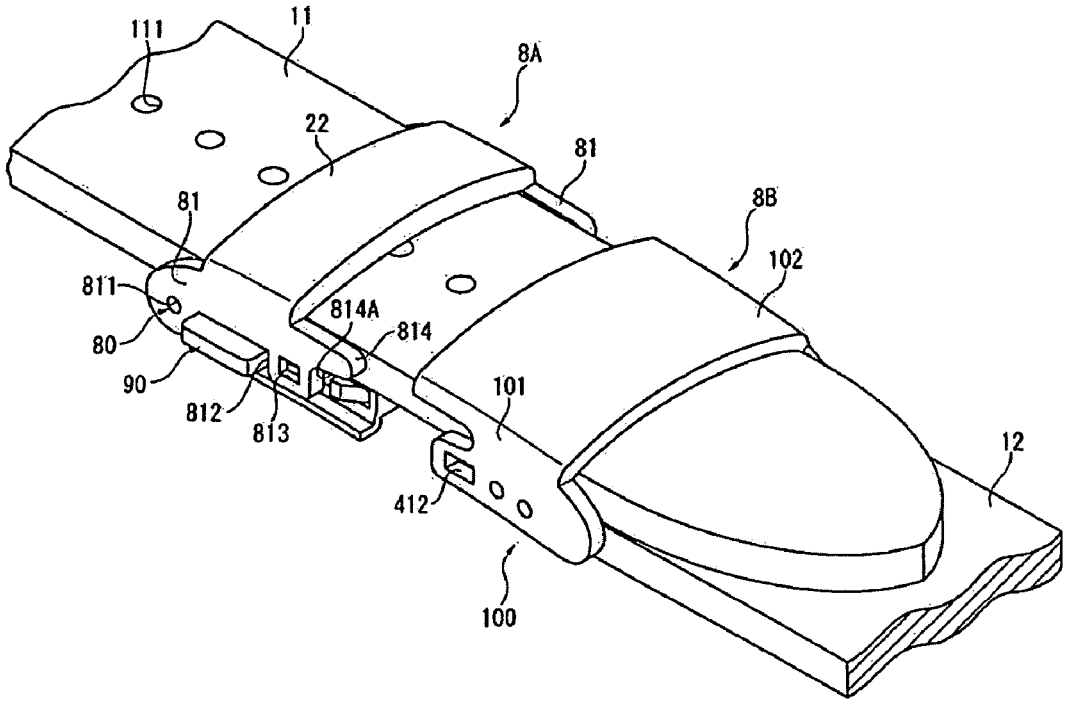
FIG. 27 shows the first member and the second member of the clasp according to the third embodiment of the invention when separated.

FIG. 26 is an oblique view of the clasp 8 in this embodiment of the invention. This clasp 8 has a first member 8A and a second member 8B. FIG. 27 shows the first member 8A and the second member 8B when unbuckled, and FIG. 28 is a side view of the first member 8A and the second member 8B.

Figure 28:
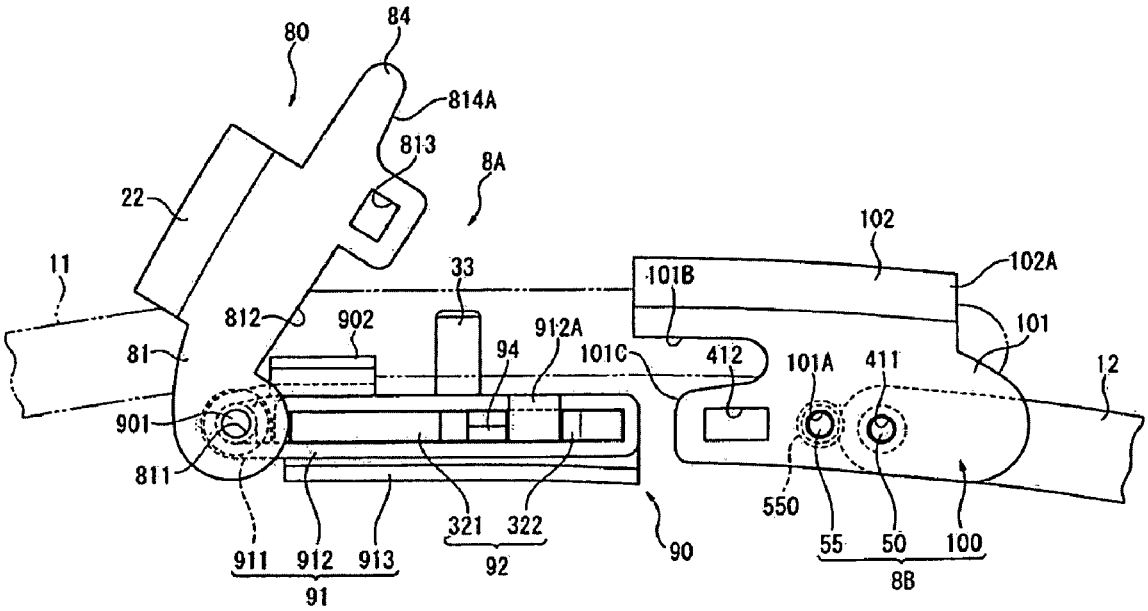
FIG. 28 is a side view of the first member and the second member.

As shown in FIG. 28, the first member 8A has a first attachment member 80, a button unit 90, a spring pin 901, and a clamping member 902. The button unit 90 pivotably connects the first attachment member 80 and the button unit 90. The clamping member 902 clamps the band 11 located between the first attachment member 80 and the button unit 90. FIG. 28 shows the first attachment member 80 and the button unit 90 pivoted on the spring pin 901 to the open position.

As shown in FIG. 27, the first attachment member 80 is substantially U-shaped in section, and has a pair of side walls 81 disposed on the opposite sides of the width of the band 11, and a spine 22 that connects the side walls 81 on the front side of the band 11. The spine 22 has a convex curved shape that bulges to the outside in the middle to conform to the section shape of a band that is stitched along the lengthwise edges of the band, that is, on both sides of the width of the band. The curved shape of the spine 22 gives the first attachment member 80 a thin appearance.

As shown in FIG. 27 and FIG. 28, pin holes 811 in which the spring pin 901 is inserted, notches 812 in which the push buttons 321 are inserted, recessed pivot locking strikes 813, and lances 814 projecting lengthwise to the band 11 towards the second member 8B are formed in the side walls 81. An incline 814A that is inclined both to the length of the band and the height of the side walls 81 is formed on the bottom of each of the lances 814.

Figure 29:
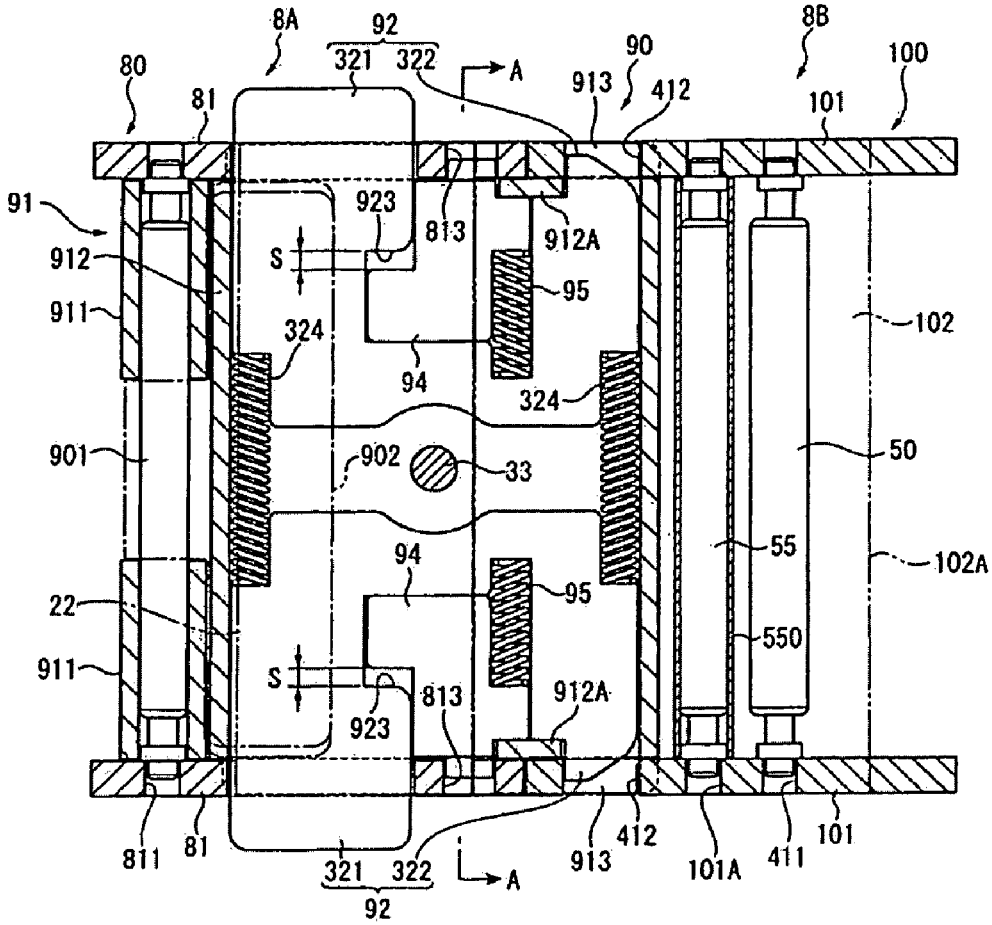
FIG. 29 is a horizontal plan view of the first member and the second member.
Figure 30:
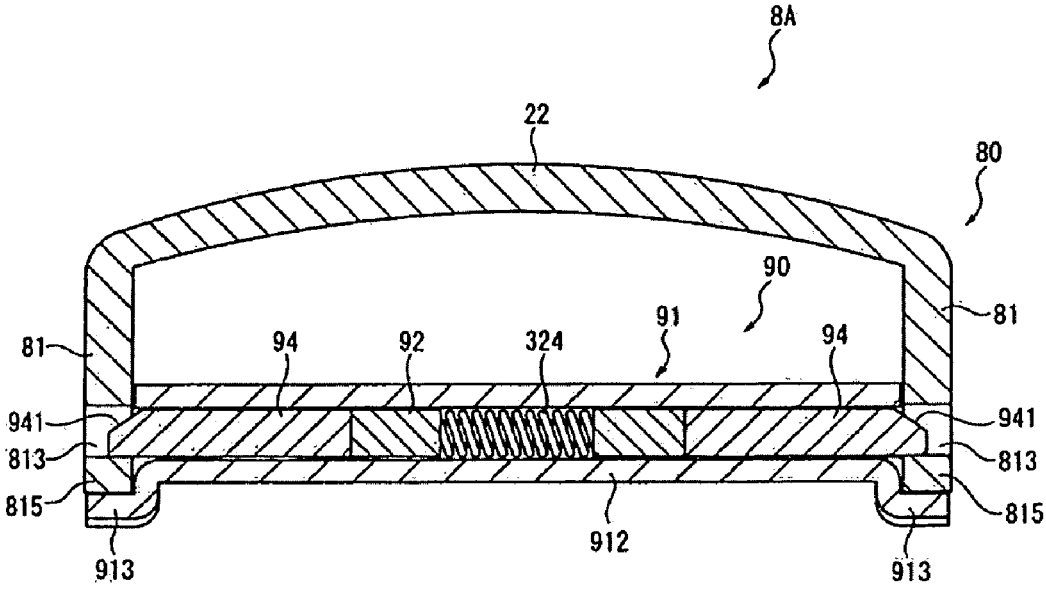
FIG. 30 is a section view through A-A in FIG. 29.

FIG. 29 is a planar section view of the first member 8A and second member 8B. FIG. 30 is a section view through line A-A in FIG. 29. FIG. 29 shows the first attachment member 80 and the button unit 90 when closed together as shown in FIG. 27.

As shown in FIG. 28 and FIG. 29, the button unit 90 has a button unit frame 91 disposed between the side walls 81 of the first attachment member 80, button members 92, pivot locking buttons 94 disposed between the push buttons 321 and the catches 322, and a stud 33 affixed to the bottom of the button unit frame 91 (see FIG. 28).

As shown in FIG. 27 and FIG. 28, the button unit frame 91 has wound parts 911, a button holding unit 912 that is substantially rectangular in section, and guide parts 913 (see FIG. 30). The wound parts 911 are formed by bending a thin metal sheet to wrap around the spring pin 901. The guide parts 913 extend along the length of the band 11 and step down towards the wrist from both edges of the button holding unit 912 along the length of the band. The length of the guide parts 913 in this embodiment is substantially equal to the size of the button unit frame 91 along the length of the band.

Stoppers 912A that are bent towards the bottom as shown in FIG. 28 and FIG. 29 are formed at a part of the top outside edge of the button holding unit 912. These stoppers 912A hold the button members 92 and the pivot locking buttons 94 in the button unit frame 91. Part of the shaped edge of the button members 92 and the pivot locking buttons 94 is hidden behind the stoppers 912A, and the stoppers 912A thus contribute to the appearance of the button unit 90.

As shown in FIG. 29, the button members 92 are flat members having a push button 321 and a catch 322 formed in unison on opposite sides of a stepped notch 923.

The pivot locking buttons 94 are flat members conforming to the shape of the notch 923, and are urged to the outside from the inside of the opening in the button unit frame 91 by compressed coil springs 95. The pivot locking buttons 94 are disposed in the notches 923 and thereby secured in the button unit frame 91. The exposed distal ends of the pivot locking buttons 94 engage the pivot locking strikes 813 of the first attachment member 80. The first attachment member 80 and button unit 90 are thus locked in unison by the pivot locking buttons 94 engaging the pivot locking strikes 813.

An incline 941 that is sloped relative to the height of the side walls 81 of the first attachment member 80 and the width of the band 11 (FIG. 27) is formed on the distal end of each of the pivot locking buttons 94 as shown in FIG. 30.

A gap S of a prescribed size widthwise to the band is formed in the notch 923 between the pivot locking button 94 and the button member 92. The gap S is sized so that dimension A is smaller than dimension B where dimension A is the distance the button member 92 travels relative to the button unit frame 91 when the catch 322 engages and releases the strike recess 412 in the second attachment member 100, and dimension B is the distance that the button members 92 move relative to the button unit frame 91 when the pivot locking button 94 engages and releases the pivot locking strike 813 in the first attachment member 80. In this embodiment of the invention gap S is sized so that the distance of travel is substantially equal to dimension A.

When the button members 92 are not pushed in against the force of the coil springs 324, the spring force of the coil springs 324 preferably pushes the catches 322 against the stoppers 912A. In addition, when the pivot locking buttons 94 are not pushed against the spring force of the coil springs 95, the spring force of the coil springs 95 preferably pushes the pivot locking buttons 94 against the stoppers 912A. This eliminates play in the button members 92 and the pivot locking buttons 94.

Figure 31:
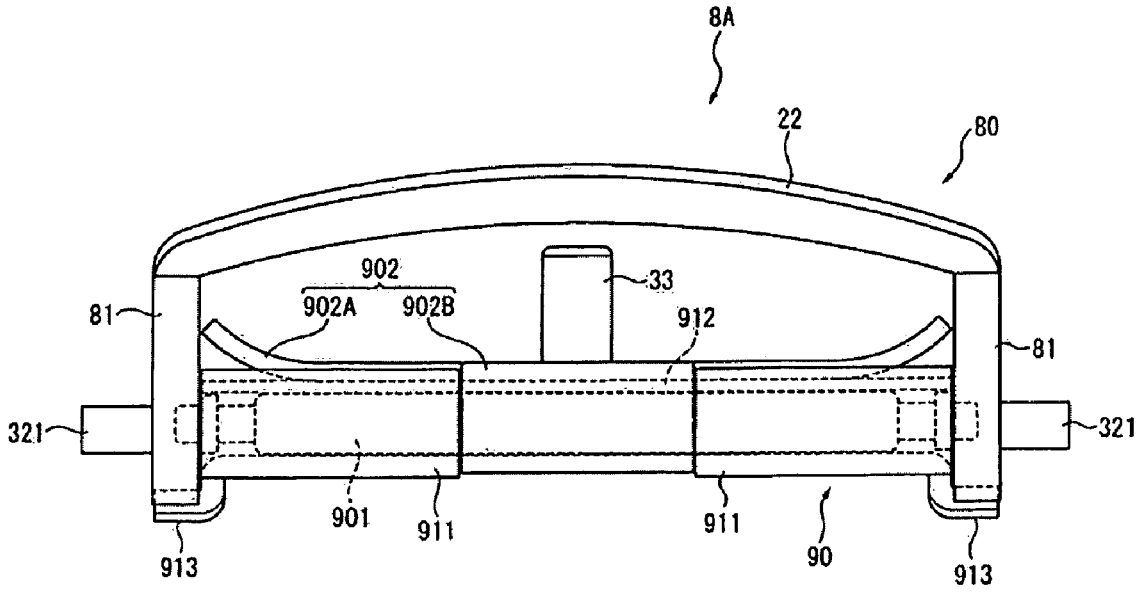
FIG. 31 is a side view of the first member.

FIG. 31 is a side view of the first member 8A from the pivot axis end. The clamping member 902 has a main body 902A and a wound part 902B. The main body 902A is disposed between the band 11 (FIG. 27) and the button unit 90. The wound part 902B is disposed between the wound parts 911 of the button unit frame 91 and is wrapped around the spring pin 901. The end parts of the clamping member 902 at the opposite sides of the width of the band curve up, press down on the band 11 at both widthwise sides, and prevent the band 11 from moving both in the thickness and width directions. The clamping member 902 can thus prevent any play that occurs when a band that is narrower than the distance between the side walls 81 of the first attachment member 80 is used.

How the first member 8A is operated to adjust the length of the band is described next. To remove the band 11 from between the first attachment member 80 and the button unit 90 when the clasp 8 is closed as shown in FIG. 26, the push buttons 321 (FIG. 29) are pushed inside the button unit frame 91 to release engagement of the pivot locking buttons 94 and pivot locking strikes 813. By pushing the push buttons 321 in a distance greater than gap S, the button members 92 contact the pivot locking buttons 94 and the pivot locking buttons 94 therefore move in conjunction with the push buttons 321 as the push buttons 321 are pushed further inside. The distance that the push buttons 321 are pushed until the pivot locking buttons 94 disengage the pivot locking strikes 813 is less in each of the embodiments than the distance that the push buttons 321 are depressed when the push buttons 321 are pushed completely inside the side walls 21 and disengage the openings 211 (see FIG. 8).

Once the pivot locking buttons 94 disengage the pivot locking strikes 813, the first attachment member 80 and button unit 90 can be pivoted relative to each other as shown in FIG. 28 to change the adjustment hole 111 to which the stud 33 is inserted in the band 11. Because the first attachment member 80 and button unit 90 are linked by a spring pin 901, the first attachment member 80 and button unit 90 do not separate when removed from the band 11 as in the preceding embodiments.

Once the stud 33 is positioned in the desired adjustment hole 111 of the band 11, the first attachment member 80 and button unit 90 are again closed together. This causes the bottom ends 815 shown in FIG. 30 of the side walls 81 of the first attachment member 80 to contact the incline 941 of the opposing pivot locking buttons 94, and the component force of this contact causes the pivot locking buttons 94 to move to the inside of the button unit frame 91. The spring force of the coil springs 95 (FIG. 29) then returns the pivot locking buttons 94 to the original position, and the distal ends of the pivot locking buttons 94 are inserted to the pivot locking strikes 813. The click of the pivot locking buttons 94 engaging the pivot locking strikes 813 provides a positive response confirming for the user that the clasp closed.

The second member 8B of this embodiment of the invention is described next. As shown in FIG. 27 to FIG. 29, the second member 8B has a second attachment member 100, a spring pin 50, and another spring pin 55. The second member 8B in this embodiment differs from the second members in the foregoing embodiments in the position of the spine 102 of the second attachment member 100, and in having another spring pin 55 separate from the spring pin 50 that secures the 12:00 o'clock side band 12 to the second attachment member 100. This second member 8B is otherwise identical to the second member 3B in the embodiments described above.

As shown in FIG. 28 and FIG. 29. The second attachment member 100 is substantially U-shaped in section view and has side walls 101 on opposite sides of the width of the band 12, and a spine 102 that connects the side walls 101.

As shown in FIG. 28, a hole 411 that engages an end of the spring pin 50, a hole 101A that engages an end of the other spring pin 55, a strike recess 412 in which the catch 322 of the button unit 90 is inserted, and a channel 101B that is recessed in line with the length of the band from the first member 8A side are formed in each of the side walls 101. An incline 101C is formed at part of the inside face of the channel 101B in the same direction as the incline 814A of the corresponding lance 814 of the first attachment member 80.

The spring pin 55 passes through a pipe 550 disposed between the side walls 101 as shown in FIG. 29, and is disposed parallel to the other spring pin 50 at the edges on the opposite sides of the width of the band 12. The second attachment member 100 is held at a desired angle of rotation pivoting on the spring pin 50 as a result of this spring pin 55 pressing the end of the band 12. This simplifies passing the 6:00 o'clock side band 11 through the spine 102 when buckling the band.

As shown in FIG. 28, the end edge 102A of the spine 102 of the second attachment member 100 is positioned lengthwise to the band 12 on the opposite side of the spring pin 50 as the first member 8A.

The end edge 102A in this embodiment of the invention is formed substantially parallel to the width of the band, and the entire end edge 102A is located on the opposite side of the spring pin 50 as the first member 8A, but the invention is not so limited. More particularly, only a part of the end edge 102A, such as the parts at the opposite sides of the width of the band, could be positioned on the opposite side of the spring pin 50 as the first member 8A.

Figure 32:
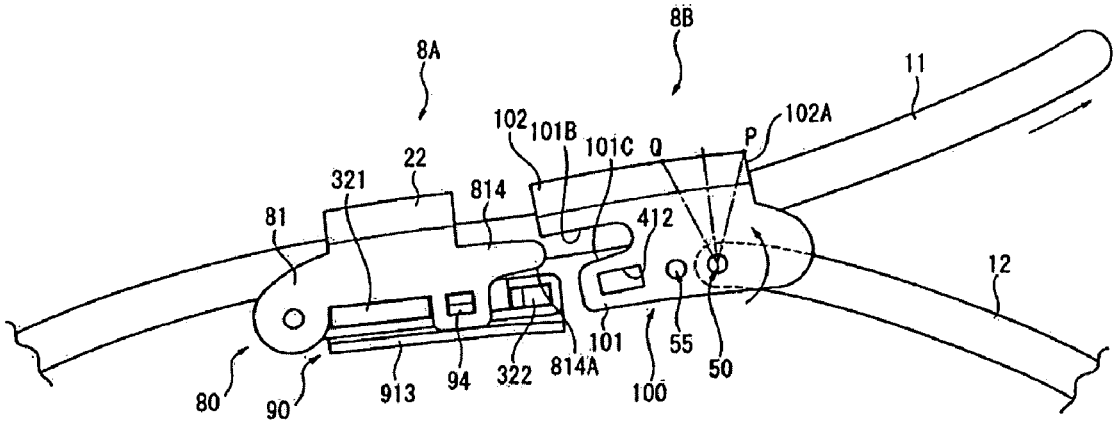
FIG. 32 shows buckling the bands with the clasp according to this embodiment of the invention.

Buckling the bands 11 and 12 closed by means of the clasp 8 according to this embodiment of the invention is substantially the same as closing the clasp 3 of the first embodiment. However, as shown in FIG. 32, when the 6:00 o'clock side band 11 is passed through the spine 102 and the free end of the band 11 is moved diagonally upwards relative to the 12:00 o'clock side band 12, the 6:00 o'clock side band 11 contacts the end edge 102A of the spine 102 at a position on the opposite side of the spring pin 50 as the first member 8A (at position P). A component force works at this time in the counterclockwise direction as seen in FIG. 32 (as indicated by the rotating arrow), and simplifies passing the band 11 through the spine 102. If the end edge 102A of the spine 102 is at point Q on the first member 8A side of the spring pin 50 so that the band 11 contacts the spine 102 at point Q, the second attachment member 100 will pivot in the direction of the rotating arrow and impede sliding the band 11. With the arrangement of this embodiment of the invention, however, the band 11 will not catch on the end edge 102A of the spine 102, and the band 11 will slide smoothly guided by the spine 102.

When the bands 11 and 12 are slid further from the position shown in FIG. 32, the incline 101C of the channel 101B of the second attachment member 100 and the incline 814A of the lances 814 of the first attachment member 80 touch. The resulting component force pushes the second attachment member 100 towards the bottom of the button unit 90, and the bottom edges of the side walls 101 contact the guide parts 913 of the button unit 90. The lances 814, channels 101B, and guide parts 913 in this embodiment thus determine the positions of the first attachment member 80 and second attachment member 100 relative to the thickness of the band, and thus enable reliably engaging the catches 322 and strike recesses 412.

The catches 322 move temporarily to the inside of the side walls 81 when the catches 322 engage the strike recesses 412, but the pivot locking buttons 94 do not move because of the gap S (FIG. 29) provided as described above between the button members 92 and pivot locking buttons 94. The first attachment member 80 and button unit 90 therefore do not separate from each other.

Furthermore, because the gap S is simply filled and the pivot locking buttons 94 do not move when the push buttons 321 are pushed to unbuckle the bands 11 and 12, the first attachment member 80 and button unit 90 will obviously still not separate.

In addition, because the guide parts 913 are formed to the button unit frame 91 at a position below the push buttons 321 as shown in FIG. 28, the bands 11 and 12 can be prevented from being accidentally unbuckled if a push button 321 is pushed unintentionally.

In addition to the effects of the foregoing embodiments described above, this embodiment has the following effects.

(7) The length of the band 11 can be adjusted without separating the first attachment member 80 and button unit 90 from each other because the first attachment member 80 and button unit 90 are pivotably connected by means of a spring pin 901. This makes adjusting the length of the band even easier.

Connecting the first attachment member 80 and button unit 90 by means of a spring pin 901 also enables locking the first attachment member 80 and button unit 90 closed by simply rotating them together.

Furthermore, by forming a gap S between the button members 92 and the pivot locking buttons 94, the pivot locking buttons 94 do not separate from the pivot locking strikes when the catches 322 engage and disengage the strike recesses 412 of the second attachment member 100, and the first attachment member 80 and button unit 90 therefore remain locked closed when the bands are buckled and unbuckled by means of the clasp.

(8) Because the distance the push buttons 321 are pushed in to adjust the length of the band 11 is less than the distance the push buttons 321 must be pushed in the preceding embodiments, adjusting the length of the band is rendered even easier.

(9) Locking the first attachment member 80 and button unit 90 together is made smoother by forming an incline 941 to each of the pivot locking buttons 94.

Variation of Embodiment 3

Figure 33:
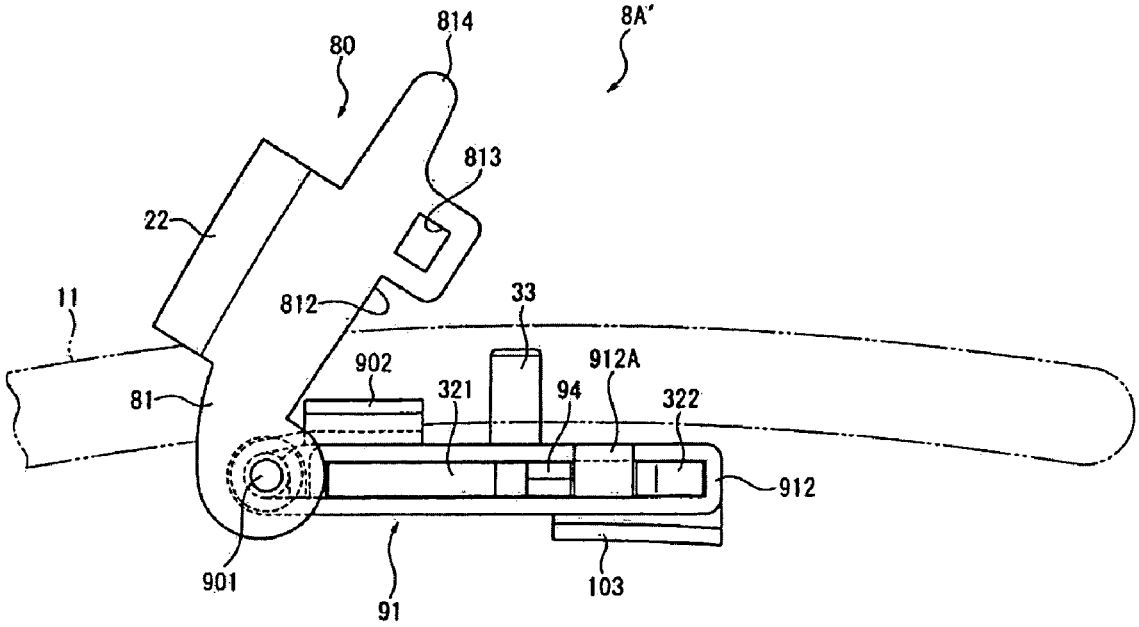
FIG. 33 shows the first member in a variation of the third embodiment of the invention.

FIG. 33 shows a first member 8A' according to a variation of the third embodiment. This first member 8A, has guide members 103 that are shorter lengthwise to the band than the guide parts 913 in the foregoing third embodiment (FIG. 28).

These guide members 103 are formed at the part of the button unit frame 91 where the catches 322 are disposed. Because the guide members 103 are not formed below the push buttons 321, the push buttons 321 can be operated more easily in this variation than in the third embodiment described above.

Other Variations of the Invention

The invention is not limited to the foregoing embodiments and can be varied and improved in many ways without departing from the scope of the accompanying claims.

Figure 34:
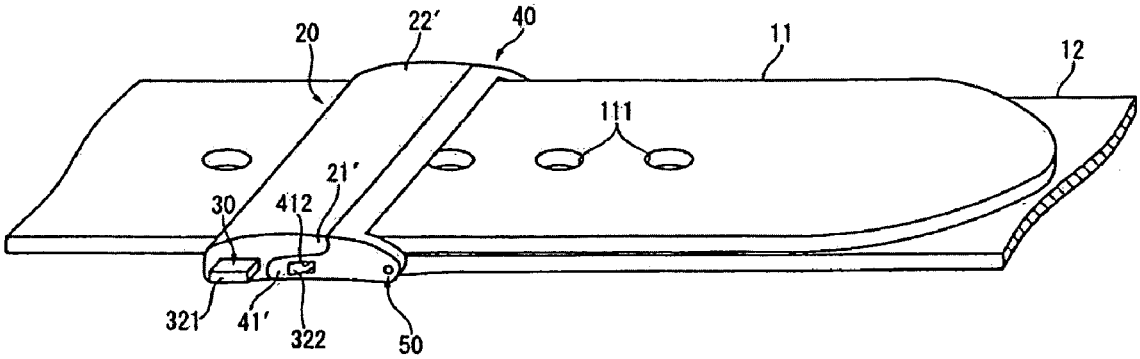
FIG. 34 shows another variation of the invention.

FIG. 34 shows a variation of the first embodiment. In this variation the side walls 21' and the spine 22' of the first attachment member 20 extend lengthwise to the band 11 toward the second attachment member 40, and the side walls 41' of the second attachment member 40 extend lengthwise to the band 12 toward the first attachment member 20 in the opposite direction as the direction in which the side walls 21' and spine 22' extend. The clasp according to this variation is otherwise substantially identical to the clasp 3 described in the first embodiment (FIG. 2).

When the bands 11 and 12 are slid together for buckling in this variation, the side walls 21' contact the side walls 41' before the catches 322 contact the side walls 41' of the second attachment member 40. This contact between the extensions of the side walls 21' and the extensions of the side walls 41' lengthwise to the bands 11 and 12 determines the positions of the first attachment member 20 and the second attachment member 40 relative to the thickness of the bands 11 and 12. As a result, the catches 322 can even more easily engage the strike recesses 412.

The first attachment member 60 in the second embodiment (FIG. 21) is substantially rectangular in section, but the first attachment member in this second embodiment could be rendered substantially U-shaped with side walls 41 and a spine connecting the side walls 41 on the wrist side (underside). A first attachment member formed with such a U-shaped configuration could be rendered with the arrangement of the variation of the first embodiment shown in FIG. 15. More specifically, a second opening contiguous to the first opening could be formed as a notch in the side walls of the first attachment member on the opposite end as the spine, and the push buttons could be formed with a necked part that can be inserted through this second opening.

Furthermore, the stud 33 that is inserted to an adjustment hole 111 in the band 11 in each of the foregoing embodiments is disposed to the button unit, but the invention is not so limited and the stud could be disposed to the spine of the first attachment member.

The invention also does not necessarily require that a hole is formed in the band or other members fastened by the clasp, and that a stud that is inserted to the hole is disposed to the first attachment member or button unit. However, by using an arrangement having a stud that is inserted to a hole, the first attachment member and button unit can be easily and reliably secured to the member that is fastened by the clasp.

An incline 322A is formed to the catches 322 in the embodiments described above, but this incline could be rendered on an edge part of the side walls of the second attachment member. More specifically, it is sufficient to form an incline with the same slope as the incline 322A on an edge part of the side wall on the side opposing the catch when the bands are slid together. An incline could also be formed on both the catch and the side wall of the second attachment member.

This also applies to the incline 941 of the pivot locking buttons 94 in the third embodiment. That is, an incline identical to this incline 941 could be formed on the top edge of the side walls 81 of the first attachment member 80. Alternatively, an incline could be formed on both the pivot locking buttons 94 and the top edge part of the side walls 81 of the first attachment member 80.

The button members are held in the button unit frame in the foregoing embodiments by means of the stoppers 312 rising from the bottom of the button unit frame 31 and the stoppers 912A formed by bending an edge part of the button unit frame 91. Instead of using such stoppers 312 and stoppers 912A, however, the button members could be held in the button unit frame by means of screws, for example, passing from the button unit frame into holes formed in the button members.

Though not described in detail below, the arrangement described in the third embodiment whereby the first attachment member 80 and button unit 90 are pivotably connected can also be applied to the arrangement described in the second embodiment whereby the band 11 is held between the button unit 70 and the extensions 23 of the first attachment member 60.

The pivot axis of the first attachment member 80 and button unit 90 in the third embodiment is disposed to the first member 8A on the opposite end as the second member 8B along the length of the band, but the invention is not so limited and the pivot axis could be located at the second member 8B end of the first member 8A. The catches are provided on the second member 8B side of the pivot axis in this case.

The shaft member pivotably connecting the first attachment member 80 and button unit 90 is also not limited to a spring pin, and any desirably configured member can be used.

A clasp according to the invention can be used for a variety of applications holding slidable members together. The bands 11 and 12 in the embodiments described above are separate members attached to a common case 2, but the invention is not so limited and the bands 11 and 12 could be a single continuous member.

The embodiments described above describe a clasp that is used to secure a timepiece band, but the clasp of the invention can be used as a clasp for a variety of other accessories.

Examples of such accessories include belts and bands that wrap around the wrist or waist, chokers that are worn around the next, and clothing clasps. The clasp of the invention can also be used other products such as briefcases and handbags, bags and pouches, and footwear.

The clasp of the invention joins two straps together, but three or more such members can be buckled together by using a plurality of such clasps. For example, if a bracelet type timepiece band is rendered using three or more curved parts, the clasp of the invention can be used to connect one part with an adjacent part.

The best modes and methods of achieving the present invention are described above, but the invention is not limited to these embodiments. More specifically, the invention is particularly shown in the figures and described herein with reference to specific embodiments, but it will be obvious to one with ordinary skill in the related art that the shape, material, number, and other detailed aspects of these arrangements can be varied in many ways without departing from the technical concept or the scope of the object of this invention.

Therefore, description of specific shapes, materials and other aspects of the foregoing embodiments are used by way of example only to facilitate understanding the present invention and in no way limit the scope of this invention, and descriptions using names of parts removing part or all of the limitations relating to the form, material, or other aspects of these embodiments are also included in the scope of this invention.

The invention being thus described, it will be obvious that it may be varied in many ways. Such variations are not to be regarded as a departure from the spirit and scope of the invention, and all such modifications as would be obvious to one skilled in the art are included within the scope of the following claims.

The entire disclosure of Japanese Patent Application Nos: 2007-104848, filed Apr. 12, 2007 and 2007-332720, filed Dec. 25, 2007 are expressly incorporated by reference herein.

What is claimed is:

1. A clasp comprising:

a first member and a second member that are respectively disposed to a first and second coupled members, the clasp being closed by the first member and the second member mutually engaging when the first and second coupled members slide opposite to each other in a sliding direction, the first member having a first attachment member that has a first spine longitudinally extending in a direction perpendicular to the sliding direction and two side walls each of which is disposed on each longitudinal end of the first spine, the first spine connecting the two side walls; and a button unit having a push button which is urged to the outside from the inside of the coupled members in a direction intersecting the sliding direction, and which is disposed with the first coupled member held between the first attachment member and the button unit, the second member having a second attachment member that has a second spine longitudinally extending in the direction perpendicular to the sliding direction and a two side walls which are attached at a prescribed position to the second coupled member, each of the two side walls is disposed on each longitudinal end of the second spine, the second spine connecting the two side walls, the first attachment member and the button unit being attached at a prescribed position to the first coupled member, the button unit having a protruding catch that moves in conjunction with the push button and engaging with the side walls of the second attachment member when the coupled members are slid together, the side walls of the second attachment member having a recessed strike to which the protruding catch is inserted from the inside of the side walls, the first coupled member being configured to be inserted between the second spine and the second coupled member, one of the first spine or the button unit having a stud that protrudes towards the other of the first spine and the button unit, the stud being configured to be inserted to a hole formed in the first coupled member.

2. The clasp described in claim 1, wherein:

when the one coupled member is attached to the attached object to which the coupled members are attached, the one coupled member is located on the attached object side of the button unit; and the coupled members are slid with the second attachment member placed on the button unit side of the one coupled member.

3. The clasp described in claim 1, wherein the first attachment member and the button unit are assembled in unison by means of the push button passing through the opening.

4. The clasp described in claim 1, wherein:

the first attachment member and the button unit are connected to pivot relative to the other on a shaft unit disposed in the direction intersecting the sliding direction of the coupled members;

the button unit has a pivot locking button that is urged to the outside from the inside of the coupled members in the direction intersecting the sliding direction of the coupled members and engages the side walls of the first attachment member, and a button unit frame that holds the push button, the protruding catch, and the pivot locking button;

the side walls of the second attachment member have a pivot locking recess in which the pivot locking button is inserted from the inside of the side walls;

the pivot locking button opposes the push button or protruding catch with a gap therebetween in the direction the push button is depressed; and the gap is sized so that A is less than B where A is the distance the push button moves relative to the button unit frame when the protruding catch engages and releases the recessed strike, and B is the distance that the push button moves relative to the button unit frame when the pivot locking button engages and releases the pivot locking recess.

5. The clasp described in claim 1, wherein:

at least one of the second member side end part of the protruding catch in the sliding direction of the coupled member, and the first member side end part of the second attachment member side walls in the sliding direction of the coupled member, is an inclined face that is sloped in the direction causing a component force to work toward the inside of the side walls of the first attachment member when the protruding catch and the side walls of the second attachment member touch because the coupled members are slid together.

6. The clasp described in claim 1, wherein the second member includes a spring pin having a rod member that is inserted in a cylinder and is pushed to the outside by a spring; and the side walls of the second attachment member are attached by the spring pin to the second coupled member.

7. The clasp described in claim 1, wherein the push button and the protruding catch are formed as parts of a single flat member; and a notch that holds a part of one of the side walls of the first attachment member and a part of one of the side walls of the second attachment member is formed between the push button and the protruding catch.

8. A band comprising the clasp described in claim 1.

9. The clasp described in claim 3, wherein the first attachment member is substantially U-shaped;

the first attachment member has a first opening on one of the two side walls and a second opening on the other of the two side walls so that the push button passes through the firs and second openings;

the size of the second opening is smaller than the size of the first opening in the sliding direction; and a necked part that is arraigned to be inserted to the second opening is formed in the part of the push button that protrudes from the first opening when the push button is not depressed.

10. The clasp described in claim 4, wherein:

at least one of the end part on the first attachment member side of the pivot locking button in the pivoting direction in which the first attachment member and the button unit come together, and the end part on the button unit side of the side wall of the first attachment member in said pivoting direction, is an inclined face that is sloped in the direction causing a component force to work toward the inside of the side walls of the first attachment member when the first attachment member and the button unit pivot together and the pivot locking button and the side wall of the first attachment member touch.

11. A portable device comprising the band described in claim 8.

12. A timepiece comprising the band described in claim 8, wherein the band is connected to a timepiece case.

13. An accessory comprising the band described in claim 8, wherein the accessory is worn by means of the band.

14. The timepiece described in claim 12, wherein the band is a timepiece band.

* * * * *